US006458424B1

(12) United States Patent
Yoshida et al.

(10) Patent No.: US 6,458,424 B1
(45) Date of Patent: Oct. 1, 2002

(54) AUTOMATIC PAINTING METHOD AND DEVICE THEREFOR

(75) Inventors: Osamu Yoshida, Tokyo (JP); Hidetsugu Matsuda, Fujieda (JP); Toshio Hosoda, Fujieda (JP)

(73) Assignee: ABB K.K., Tokyo (JP)

( * ) Notice: Subject to any disclaimer, the term of this patent is extended or adjusted under 35 U.S.C. 154(b) by 0 days.

(21) Appl. No.: 09/601,344

(22) PCT Filed: Dec. 9, 1999

(86) PCT No.: PCT/JP99/06920

§ 371 (c)(1),
(2), (4) Date: Aug. 17, 2000

(87) PCT Pub. No.: WO00/37182

PCT Pub. Date: Jun. 29, 2000

(30) Foreign Application Priority Data

Dec. 18, 1998 (JP) ..... 10-360958

(51) Int. Cl.[7] ..... B05D 1/02
(52) U.S. Cl. ..... 427/421; 118/302; 118/323
(58) Field of Search ..... 427/421; 118/302, 118/323, 688

(56) References Cited

U.S. PATENT DOCUMENTS 4,785,760 A 11/1988 Tholome
6,071,346 A * 6/2000 Yamauchi et al. ..... 118/668

FOREIGN PATENT DOCUMENTS

| | | |
|---|---|---|
| JP | 63-175662 | 7/1988 |
| WO | WO 97/34707 | 9/1997 |
| WO | 98/43745 | * 10/1998 |

* cited by examiner

*Primary Examiner*—Katherine A. Bareford
(74) *Attorney, Agent, or Firm*—Oblon, Spivak, McClelland, Maier & Neustadt, P.C.

(57) ABSTRACT

When replacing a paint cartridge (25) on the coating apparatus (11), a replenished paint cartridge of a next paint color is picked up from one of paint replenisher units (55*a* to 55*n*) by one gripper member (101) of a cartridge gripper (100). In the next place, while the replenished paint cartridge (25) is being continuously gripped on one gripper member (101), a consumed or empty paint cartridge (25) is gripped and removed from the housing (12) by the other gripper member (102). Then, the replenished paint cartridge on one gripper member (101) is loaded on the housing (12), and the empty paint cartridge (25) is returned to a corresponding one of the paint replenisher units (55*a* to 55*n*). Thus, the paint cartridges (25) can be replaced in a significantly simplified manner.

2 Claims, 16 Drawing Sheets

AUTOMATIC PAINTING METHOD AND DEVICE THEREFOR

CROSS REFERENCE TO RELATED APPLICATION

The present document is a national stage application of PCT/JP99/06920, filed on Dec. 9, 1999.

TECHNICAL FIELD

This invention relates to an automatic coating method for carrying out coating operations in various colors automatically by selectively loading and unloading paint cartridges of different colors into and from a coating apparatus, and an automatic coating apparatus therefor.

BACKGROUND ART

Generally, for coating objects like vehicle bodies, for example, rotary atomizing head type coating apparatus which are equipped with a rotary atomizing head have been in wide use. Lately, coating apparatus of this sort are increasingly required to meet demands for reductions of the amounts of paint and solvent to be discarded at the time of color changes and for capability of coping with a large number of paint colors.

As a first example of the prior art of this category, Japanese Laid-Open Patent Publication No. H8-229446 describes a rotary atomizing head type coating apparatus which is so arranged as to reduce the amounts of discarding paint and solvent and which can cope with an increased number of paint colors. This rotary atomizing head type coating apparatus employs paint cartridges which are filled with different paint colors and adapted to be selectively and replaceably mounted on the coating apparatus in the course of a coating operation on vehicle bodies. However, no description is given in this prior art with regard to an apparatus for changing the paint cartridges.

As a second example of the prior art, there has been known an automatic coating apparatus (e.g. from Japanese Laid-Open Patent Publication No. S63-175662) which is arranged to perform a coating operation automatically according to programmed procedures. According to this prior art automatic coating apparatus, paint cartridges of various colors are located within a working area of a coating robot or other working mechanism, and, at the time of cartridge replacement, the working mechanism is operated to serve as a cartridge changer. Therefore, in this case each one of the paint cartridges needs to be located within a reach of the working mechanism. However, actually there is a limit to the number of paint cartridges which can be located within a working area of a working mechanism.

Further, as a third example of the prior art, there has been known an automatic coating apparatus as described in International Gazette WO97/34707. This third prior art coating apparatus is comprised of a working mechanism such as a coating robot which is provided in a coating area, a coating machine which is mounted on the working mechanism and provided with a rotary atomizing head adapted to be put in high speed rotation by an air motor for atomizing paint into finely divided particles, a number of paint cartridges which are filled with paint of different colors and adapted to be replaceably mounted on the coating machine, and a cartridge changer which is arranged to support the respective paint cartridges and mount and dismantle a paint cartridge on and from the coating apparatus for cartridge replacement.

In this case, the cartridge changer is provided with a round support table which is arranged to support a large number of paint cartridges in an annular array. The cartridge support table is turned by a drive motor or the like to bring a paint cartridge to be used for a coating operation, to a predetermined pick-up position.

In the case of the third prior art automatic coating apparatus which is arranged in the manner just described, paint is supplied from a cartridge to a coating machine of the coating apparatus to spray the paint toward a coating object. At this time, the working mechanism is put in operation to move the coating apparatus along contours of coating surfaces of a coating object.

When changing the paint color, the working mechanism is moved to bring the paint cartridge on the coating apparatus to a predetermined cartridge changing position of the cartridge changer. Then, a cartridge gripper which is provided on the side of the cartridge changer is operated to remove a consumed or empty paint cartridge from the coating apparatus and return same to the cartridge support table. Nextly, a fresh paint cartridge which is filled with a next color is picked up from the cartridge support table and mounted on the coating apparatus.

The cartridge changer according to the prior art just mentioned is arranged to locate a selected one of the paint cartridges on the cartridge support table in a predetermined pick-up position by turning the support table, and mounted on the coating apparatus in place of a cartridge of a previous color.

However, the cartridge support table, which carries a large number of paint cartridges in an annular array, is necessarily large in size and weight. It follows that, for driving the cartridge support table, the cartridge changer is required to have a drive motor with large driving power. Needless to say, a cartridge changer of a large size is disadvantageous in that it invites increases in cost.

DISCLOSURE OF THE INVENTION

In view of the above-mentioned problems with the prior art, it is an object of the present invention to provide an automatic coating method and apparatus for putting the method into practice, in which a large number of paint cartridges of different colors are arranged and located in such an efficient manner as to facilitate cartridge replacements and to realize reductions in size and cost of the coating apparatus in addition to improvements in working efficiency.

In order to achieve the above-stated objective, according to the present invention, there is provided an automatic coating method which is applied by the use of a working mechanism located in a coating area, a coating apparatus mounted on the working mechanism and adapted to be replaceably loaded with paint cartridges of various colors, and a cartridge changer including a paint replenishing means for replenishing paint into the paint cartridges and a cartridge gripper means having a couple of gripper members for gripping paint cartridges separately thereon and adapted to hand over paint cartridges to and from the coating apparatus to replace an empty paint cartridge on the coating apparatus by a replenished paint cartridge.

The automatic coating method according to the present invention comprises: coating step of coating object by the coating apparatus loaded with a replenished paint cartridge and moved by the working mechanism; a replenished paint cartridge picking up step of picking up said replenished paint cartridge of a color to be used in a next coating operation from a paint replenisher means by the use of one of the gripper members of the cartridge gripper means; an empty paint cartridge unloading step of unloading said empty paint cartridge from the coating apparatus by the use of the other one of the gripper members of the cartridge gripper means having the replenished paint cartridge still gripped in one gripper member; the replenished paint cartridge loading step of loading said replenished paint cartridge into the coating apparatus by one gripper member of the cartridge gripper means having the empty paint cartridge still gripped on the other gripper member; and returning the unloaded empty paint cartridge to the paint replenishing means.

With the arrangements just described, in the coating step, the working mechanism is put in motion to perform a coating operation by the coating apparatus which is loaded with a replenished paint cartridge. In the step of picking up a replenished paint cartridge, a replenished paint cartridge is gripped and picked up from the paint replenishing means by one of the gripper members of the cartridge gripper means. Nextly, in the empty cartridge unloading step, the empty paint cartridge is picked up from the coating apparatus by the other gripper member of the cartridge gripper means while gripping the replenished paint cartridge by one of the gripper members of the cartridge gripper means. In the replenished paint cartridge loading step, the replenished paint cartridge is loaded into the coating apparatus by one of the gripper members of the cartridge gripper means while gripping the empty cartridge by the other gripper member of the cartridge gripper means. Thus, in the empty cartridge returning step, a replenished paint cartridge and an empty paint cartridge are exchanged between the coating apparatus and the cartridge changer.

According to the present invention, there is also provided an automatic coating apparatus suitable for putting the above-described method into practice, which basically includes a working mechanism located in a coating area, a coating apparatus mounted on and moved by the working mechanism and adapted to be replaceably loaded with paint cartridges of various colors, and a cartridge changer arranged to hand over paint cartridges to and from the coating apparatus to replace an empty paint cartridge on the coating apparatus by a replenished paint cartridge.

The cartridge changer used in the automatic coating apparatus according to the present invention comprises: a paint replenishing means having a number of paint replenishers correspondingly for different paint colors, each adapted to support and replenish a paint cartridge of a corresponding color; a cartridge transfer means arranged to transfer paint cartridges in the directions of three perpendicularly intersecting axis; and a cartridge gripper means supported on the cartridge transfer means and adapted to grip and transfer paint cartridges between the coating apparatus and the paint replenishing means.

With the arrangements just described, upon finishing a coating operation, the coating apparatus with an empty paint cartridge is located at a cartridge replacing position, whereupon the cartridge means is actuated to move the cartridge gripper means toward that position. At this time, the cartridge gripper means is operated to transfer and exchange an empty paint cartridge and a replenished paint cartridge of a next color between the coating apparatus and the paint replenishing means. Besides, in preparation for use in a next coating operation, the empty paint cartridge which has been handed over to and set on the paint replenishing means is replenished with paint concurrently with a coating operation by the coating apparatus.

The coating apparatus to be used in the present invention is preferably constituted by a cartridge mount portion to be replaceably loaded with paint cartridges, and a coating machine with a rotary atomizing head for atomizing and spraying paint supplied from a paint cartridge loaded in the cartridge mount portion.

With the arrangements just described, as soon as paint is spurted out from a paint cartridge which is loaded in the cartridge mount portion, it is atomized into finely divided particles and sprayed toward a coating object by the rotary atomizing head of the coating machine.

Further, preferably, the paint cartridges to be used in the present invention are each constituted by a container to be filled with paint, and a feed tube extended axially from one end of the container, and the paint replenishing means is adapted to replenish paint into the container of the paint cartridge through a fore end of the feed tube.

With the paint cartridge construction just described, paint can be replenished into the container of a paint cartridge which has been handed over to and set on the paint replenishing means, thereby utilizing the fore end of the feed tube as a replenishing port.

In this instance, preferably, the paint cartridges are each constituted by a container to be filled with paint and a feed tube axially extended from a fore end of the container, and the paint replenishing means is constituted by a plural number of replenishing stools for replenishment of various paint colors, each having a feed tube passage hole formed axially therein to receive the feed tube of a corresponding paint cartridge, and a connector member located in the replenishing stool located in a deeper position than the feed tube passage hole to connect the fore end portion of the feed tube to a paint supply passage.

With the arrangements just described, when an empty paint cartridge is returned to a replenishing stool, the feed tube of the cartridge is inserted into the feed tube passage hole on the side of the stool until its fore end is connected to the connector member for communication with the paint supply passage. Therefore, paint which is supplied to the paint supply passage is replenished into the container via the connector member and the feed tube.

Further, preferably the cartridge transfer means to be used in the present invention is constituted by a first transfer mechanism arranged to move the cartridge gripper means in a longitudinal or transverse direction of the paint replenishing means, a second transfer mechanism arranged to move the cartridge gripper means in a transverse or longitudinal direction, and a third transfer mechanism arranged to move the cartridge gripper means in a vertical direction, and the cartridge gripper means is supported on the third transfer mechanism.

With the arrangements just described, the cartridge gripper means is moved in longitudinal, transverse and vertical directions by the first to third transfer mechanisms and located in the cartridge replacing position or in a cartridge pick-up position over a selected one of paint cartridges which are supported on the paint replenishing means. In addition, the cartridge gripper means is moved vertically up or down by the third transfer mechanism at the time of lifting up or lifting down a paint cartridge from or onto the coating apparatus or paint replenishing means.

Further, preferably the cartridge gripper means to be used in the present invention is provided with a couple of gripper members side by side to grip a couple of paint cartridges separately and independently of each other.

With the arrangements just described, a replenished paint cartridge is gripped in one of the gripper members of the cartridge gripper means at the time when an empty paint cartridge is unloaded from the coating apparatus by the other one of the gripper members at the time of replacement. Therefore, the replenished paint cartridge can be loaded into the coating apparatus immediately after removal of the empty paint cartridge.

Further, according to the present invention, the cartridge changer is provided with a shock absorber provided between the cartridge transfer means and the cartridge gripper means to permit movements of the cartridge gripper means relative to the cartridge transfer means when brought into abutting engagement with a paint cartridge.

With the arrangements just described, when the cartridge gripper means is moved toward and abutted against a paint cartridge by the cartridge transfer means, the shock absorber permits the cartridge gripper means to move for buffering the impacts of abutment.

Further, according to the present invention, the automatic coating apparatus further comprises a washer means which is located in the vicinity of a cartridge replacing position of the cartridge changer for washing the coating apparatus each time when replacing an empty paint by a replenished paint cartridge of a different color.

With the arrangements just described, when the coating apparatus is located in a cartridge replacing position for cartridge replacement, deposited previous color on the coating apparatus can be washed off by the washer.

BEST MODE FOR CARRYING OUT THE INVENTION

Figure 1:
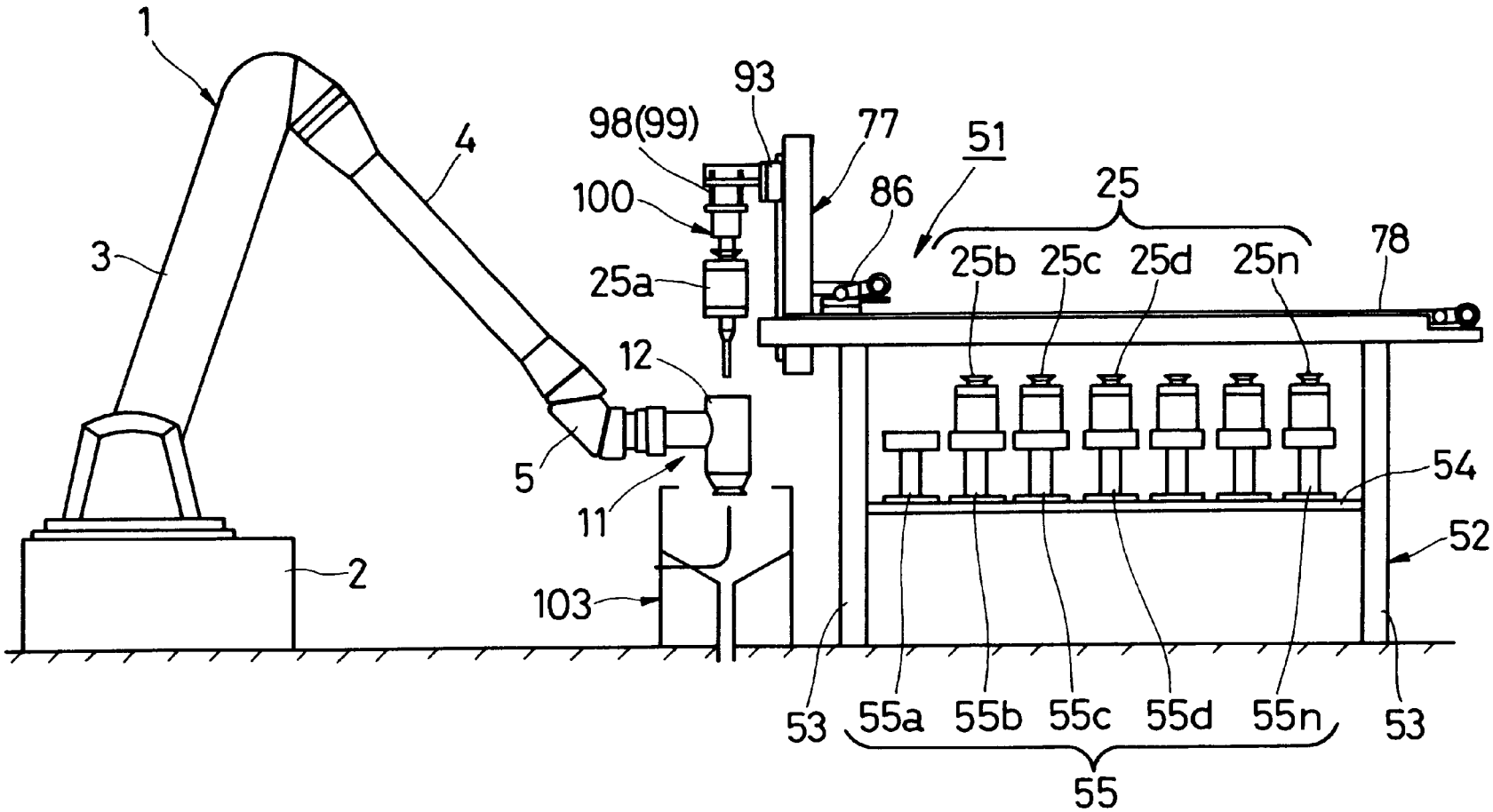
FIG. 1 is a front view of an automatic coating apparatus with a cartridge changer embodying the present invention.

Hereafter, the automatic coating apparatus according to the present invention is described more particularly by way of its preferred embodiments with reference to FIGS. 1 through 19 of the accompanying drawings.

In the drawings, indicated at 1 is a coating robot employed as a working mechanism. The coating robot 1 is largely constituted by a base 2, a vertical arm 3 which is rotatably and pivotally supported on the base 2, a horizontal arm 4 which is pivotally connected to a fore end portion of the vertical arm 3, and a wrist 5 which is provided at a fore distal end of the horizontal arm 4.

Figure 2:
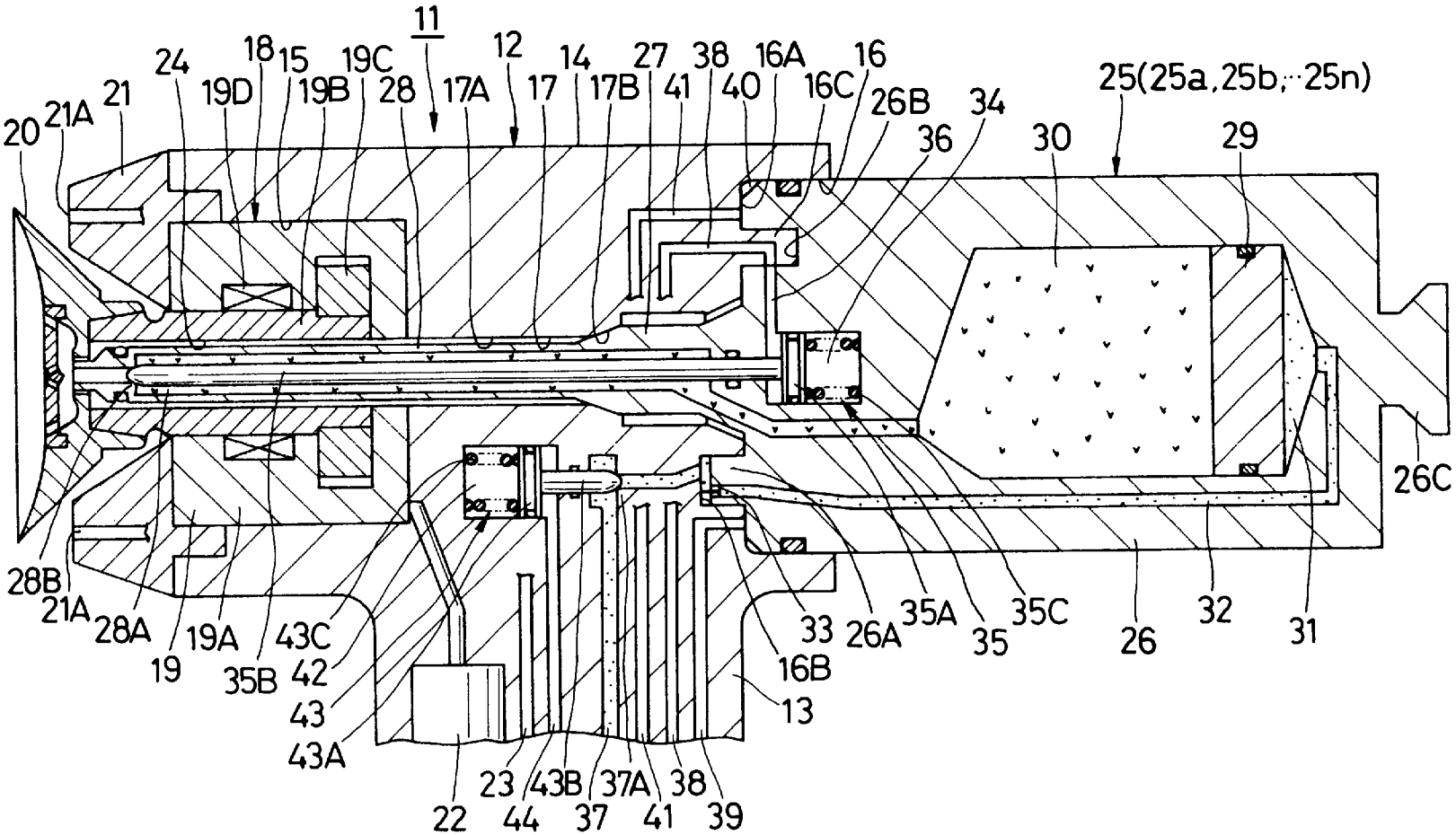
FIG. 2 is an enlarged vertical sectional view of a rotary atomizing head type coating apparatus shown in FIG. 1.

Indicated at 11 is a rotary atomizing head type coating apparatus (hereinafter referred to simply as "coating apparatus 11" for brevity) which is mounted on the coating robot 1. As shown in FIG. 2, the coating apparatus 11 is largely constituted, as described in greater detail hereinafter, by a housing 12, feed tube passage holes 17 and 24, a coating machine 18, a paint cartridge 25, a paint valve 35, and a thinner valve 43.

Indicated at 12 is the housing which is formed of engineering plastics such as PTFE, PEEK, PEI, POM, PI, PET and the like, and which is detachably attached to the fore end of the wrist 5. The housing 12 constitutes a cartridge mount portion along with the coating machine 18, and includes a neck portion 13, which is detachably attached to the distal end of the wrist 5 of the coating robot 1, and a head portion 14 which is formed integrally at the fore end of the neck portion 13.

In this instance, the housing 12 is provided with a coating machine mount portion 15 and a cartridge mount portion 16, each in the form of a cylindrical cavity, on the front and rear sides of the head portion 14, respectively. Further, female and male coupling portions 16B and 16C are provided separately at the bottom 16A of the cartridge mount portion 16 for fitting engagement with male and female coupling portions 26A and 26B which are provided on the side of a container 26 as will be described hereinafter. The female and male coupling portions 16B and 16C on the cartridge mount portion 16 function to orient the container 26 into position in the circumferential direction as the container 26 is mounted on the cartridge mount portion 16.

Indicated at 17 is the feed tube passage hole which is provided on the side of the housing and formed between and in communication with the coating machine mount portion 15 and the cartridge mount portion 16. This feed tube passage hole 17 on the side of the housing is composed of a front portion in the form of a feed tube passage portion 17A of a small diameter and a rear portion in the form of a conically converging portion 17B. In this instance, the feed tube passage portion 17A is formed in coaxial relation with the feed tube passage hole 24 which is provided on the side of the coating machine as will be described hereinafter. On the other hand, the conically converging portion 17B is brought into abutting and fitting engagement with a conical projection 27 which is provided on the side of the paint cartridge 25 as will be described hereinafter, for orienting the paint cartridge into position in both axial and radial directions.

Indicated at 18 is the coating machine which is set in the coating machine mount portion 15 of the head portion 14. In this instance, the coating machine 18 is largely constituted by an air motor 19 including a motor case 19A, rotational shaft 19B, air turbine 19C and air bearing 19D, a rotary atomizing head 20 to be put in rotation by the air motor 19 for centrifugally atomizing supplied paint into finely divided particles and spraying same toward a coating object 106 which will be described hereinafter, and a shaping air ring 21 which is provided on the front side of the air motor 19.

Figure 3:
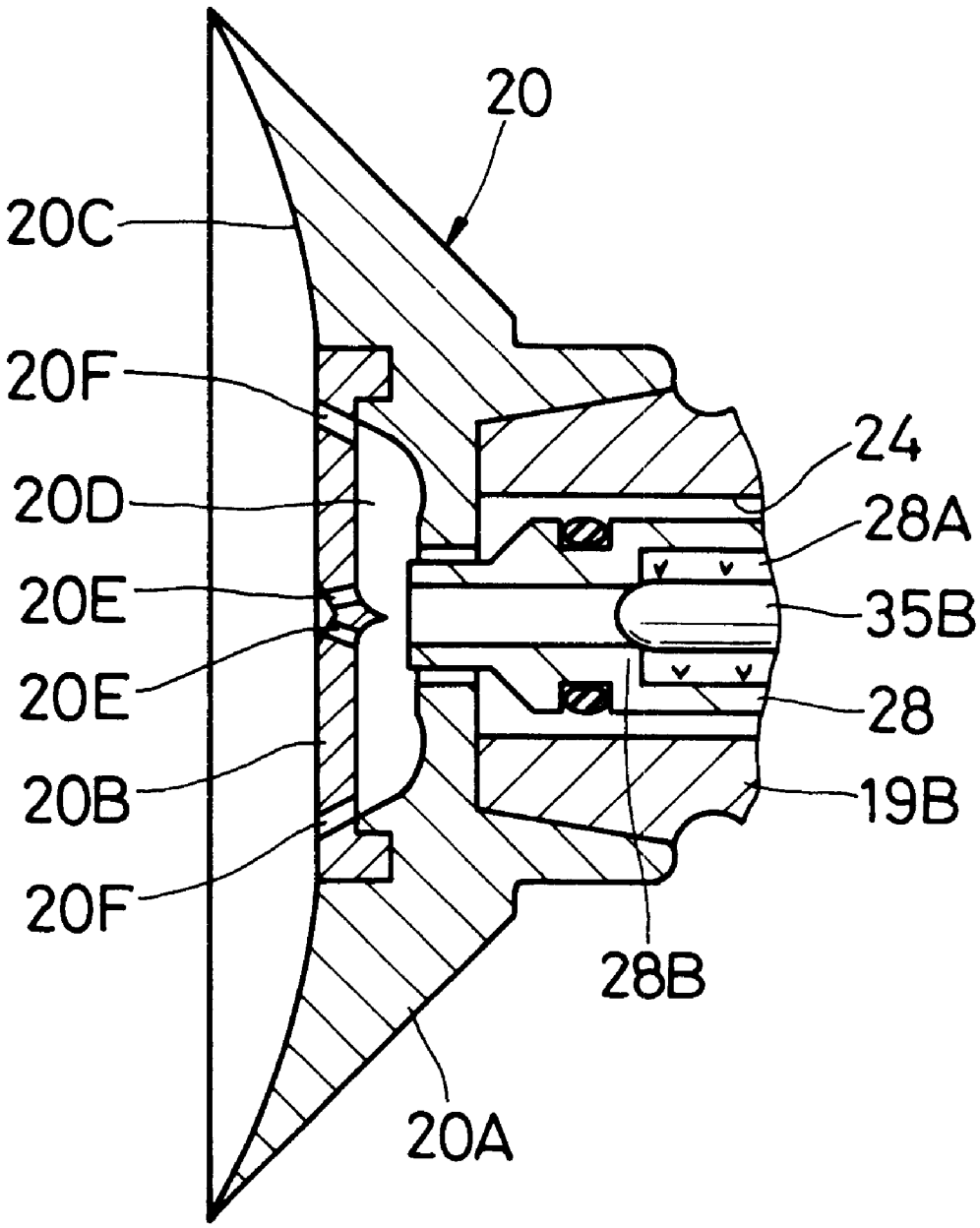
FIG. 3 is an enlarged vertical sectional view of a rotary atomizing head shown in FIG. 1.

On the other hand, as shown in FIG. 3, the rotary atomizing head 20 is constituted by: a bell cup 20A which is formed in a bell-like shape; a circular disk-like hub member 20B which is fitted in a center portion on the front side of the bell cup 20A; a paint spreading surface 20C which is formed on outer peripheral portions on the front side of the bell cup 20A for spreading paint in a thin film; a paint reservoir 20D which is defined on the rear side of the hub member 20B, a plural number of wash fluid inlet holes 20E which are formed in center portions of the hub member 20B to let a wash fluid to flow into the paint reservoir 20D from the front side of the hub member 20B; and a large number of paint outlet holes 20F which are formed in outer peripheral portions of the hub member 20B to guide paint, which is spurted out from the feed tube 28, toward the above-mentioned paint spreading surface 20C.

The shaping air ring 21 is bored with a multitude of shaping air outlet holes 21A on its outer peripheral side for spurting shaping air toward paint releasing edges of the rotary atomizing head 20 to shape released paint particles into a predetermined spray pattern.

Designated at 22 is a high voltage generator which is provided on the neck portion 13 of the housing 12. For example, the high voltage generator 22 is constituted by a Cockcroft circuit which is adapted to elevate a source voltage from a power supply (not shown) to a high voltage of from −60 kv to −120 kv. The output side of the high voltage generator 22 is connected, for example, to the air motor 19 to apply a high voltage to the rotary atomizing head 20 through the rotational shaft 19B of the air motor 19 for directly charging paint particles.

Indicated at 23 are a plural number of air passages which are provided on the neck portion 13 of the housing 12 and are connected from a control air source (not shown), for supplying turbine air, bearing air and brake air to be supplied to the air motor for the control thereof, in addition to shaping air to be supplied to the shaping air ring for shaping the paint spray pattern. In the drawings, only one air passage is shown to represent various air passages just mentioned.

Indicated at 24 is the feed tube passage hole which is provided on the side of the coating machine, axially through the rotational shaft 19B of the air motor 19. This feed tube passage hole 24 on the side of the coating machine has its base end opened into a feed tube passage portion 17A of the feed tube passage hole 17 on the side of the housing and its fore end opened into the paint reservoir 20D of the rotary atomizing head 20. Further, the feed tube passage hole 24 on the side of the coating machine is formed in coaxial relation with the feed tube passage portion 17A of the feed tube passage hole 17 on the part of the housing. The feed tube 28 of the paint cartridge 25 is extractably passed into these feed tube passage holes 17 and 24.

Figure 4:
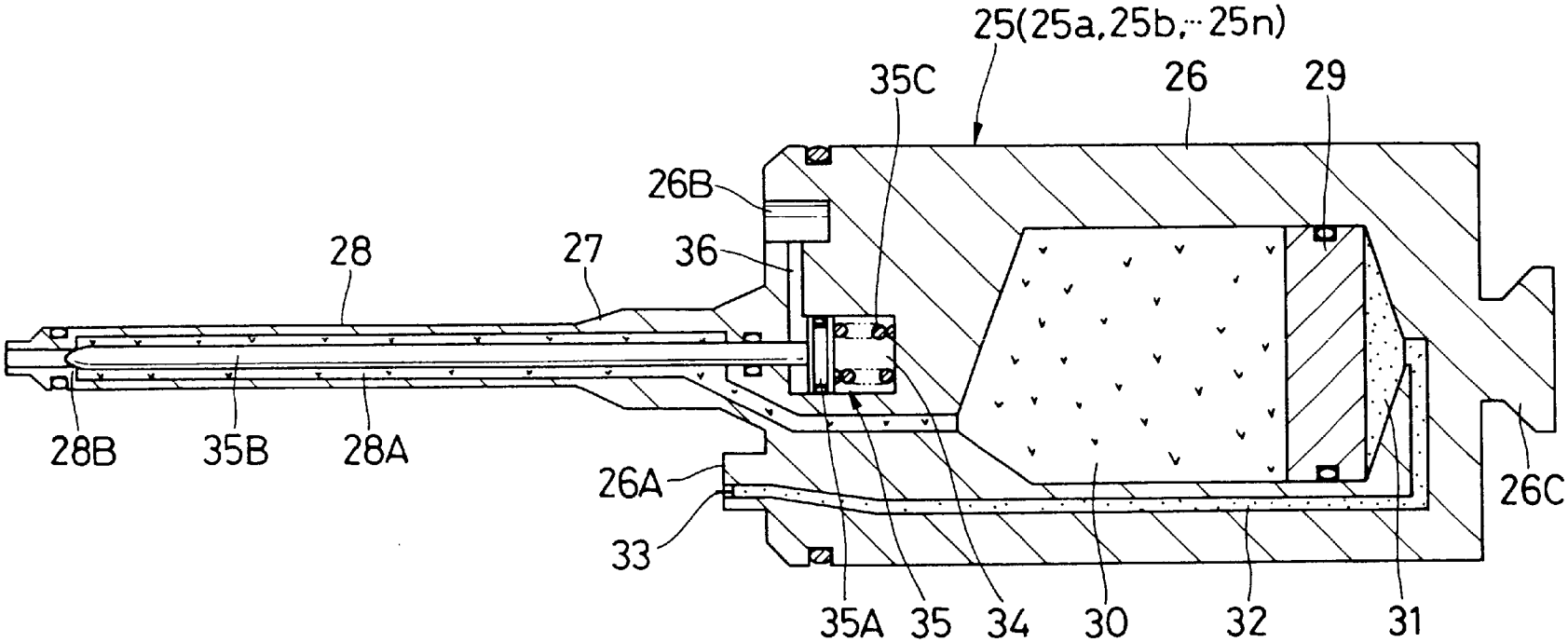
FIG. 4 is a vertical sectional view of a paint cartridge on an enlarged scale.

Denoted at 25*a*, 25*b*, . . . 25*n* are paint cartridges of different colors (hereinafter referred to simply as "cartridges 25" for brevity) which are filled with paint of different colors a, b, . . . n to be supplied to the rotary atomizing head 20. As shown in FIG. 4, each one of these cartridges 25 is largely constituted by a container 26, a conical projection 27 which is provided at a front end of the container 26, a feed tube 28 which is extended out axially forward from the conical projection 27, a piston 29 which is fitted in the container 26, and a thinner passage 32 which is provided on the side of the paint cartridge to supply till therethrough thinner as a paint extruding liquid.

The container 26 of the paint cartridge 25 is formed of engineering plastics, for example, similar to the housing 12, and provided with a cylindrical body (a cylinder) of a diameter which can be removably fitted in the cartridge mount portion 16 on the housing. Further, the container 26 is provided with male and female coupling portions 26A and 26B on its front end face in confronting positions relative to the female and male coupling portions 16B and 16C on the side of the cartridge mount portion 16, respectively. The container 26 is closed at its base or rear end, and provided with a knob 26C of an outwardly diverging shape integrally at the rear end. This knob 26C is adapted to be gripped by a cartridge gripper 100 which will be described in greater detail hereinafter.

The above-mentioned male and female coupling portions 26A and 26B serve to orient the container 26 into position in the circumferential direction when the latter is set in the cartridge mount portion 16. These male and female coupling portions 26A and 26B also serve to orient the container 26 into position in the circumferential direction when the container is set on a container support portion 61 of a paint replenisher 55 which will be described hereinafter.

Indicated at 27 is a conical projection which is formed integrally at the fore end of the container 26. This conical projection 27 is brought into abutting and fitting engagement with the conically converging portion 17B when the container 26 of the paint cartridge 25 is set in the cartridge mount portion 16 of the housing 12, for orienting the container 26 into position in both axial and radial directions. Also, the conical projection 27 is brought into abutting and fitting engagement with the inwardly converging conical portion 60A which is formed on a feed tube passage hole 60 on the side of the replenishing stool, when the paint cartridge 25 is set in a container support portion 61 of a paint replenisher 55, for orienting the container of the paint cartridge 25 into position in both axial and radial directions.

The feed tube 28 which is provided at the distal end of the conical projection 27 is internally provided with a coaxial paint supply passage 28A, which has its base end connected to a paint reservoir chamber 30, which will be described hereinafter, and has its fore end opened toward the rotary atomizing head 20. Further, provided on the inner periphery of a fore end portion of the feed tube 28 is a valve seat 28B which is formed by reducing the diameter of part of the above-mentioned paint supply passage 28A. A valve member 35B of the paint valve 35, which will be described hereinafter, is seated on and off the valve seat 28B. The feed tube 28 is arranged in such a length that its fore end is extended into the rotary atomizing head 20 when the paint cartridge 25 is set in position within the cartridge mount portion 16.

In this instance, the feed tube 28 allows paint to flow into the paint supply passage 28A from the paint reservoir chamber 30 and to flow out toward the rotary atomizing head 20 from the fore distal end of the paint supply passage 28A. Further, at the time of replenishing paint into the paint reservoir chamber 30, the fore distal end of the feed tube 28 is connected to a connector member 63 of a paint replenisher to serve as a replenishing port for the cartridge.

On the other hand, the piston 29 is axially slidably fitted in the container 26 to divide the internal space of the container 26 into a paint reservoir chamber 30, which is in communication with the paint supply passage 28A of the feed tube 28, and a thinner chamber 31 to which thinner is supplied as a paint extruding liquid.

Indicated at 32 is a thinner passage on the side of the paint cartridge, the thinner passage 32 being extended axially through an outer peripheral portion of the container 26 and having one end opened in the distal end face of the male coupling portion 26A of the container 26 and the other end communicated with the above-mentioned thinner chamber 31. As thinner is supplied to the thinner chamber 31 through this thinner passage 32 on the side of the paint cartridge, the piston 29 is pushed toward the feed tube 28 thereby to extrude paint in the paint reservoir chamber 30 toward the rotary atomizing head 20.

In this regard, thinner to be employed as a paint extruding liquid should be of a type which has electrically insulating properties or high electric resistance, in order to prevent the high voltage from the high voltage generator 22 from leaking through thinner. In case thinner is used as an extruding liquid, it contributes to retain inner wall surfaces of the container 26 always in a wet state as the piston 29 is displaced within the container 26, preventing paint from getting dried up and solidifying on the inner wall surfaces and stabilizing frictional resistance between the piston 29 and the inner wall surfaces of the container 26 to ensure smooth movement of the piston 29. Besides, it also contributes to enhance the tightness of the seal between the piston 29 and inner wall surfaces of the container 26.

Indicated at 33 is a quick coupling which is provided within the male coupling portion 26A of the container 26, at an open end of the thinner passage 32 on the side of the paint cartridge. When the paint cartridge 25 is set in position within the cartridge mount portion 16, bringing the male coupling portion 26A into engagement with the female coupling portion 16B, a valve in the quick coupling 33 is opened to communicate the thinner passage 32 on the side of the cartridge with the thinner passage 39 on the side of the housing which will be described hereinafter. On the other hand, when the container 26 is removed from the cartridge mount portion 16, thereby disengaging the male coupling portion 26A from the female coupling portion 16B, the thinner passage 32 on the side of the paint cartridge is closed by the action of a valve spring to prevent thinner from flowing out of the thinner passage 32. Also, the opening and closing operations of the quick coupling 33 are performed in case of loading or unloading the paint cartridge to the container support portion 61 of the replenishing stool 56 which will be described hereinafter.

Indicated at 34 is a paint valve accommodating portion which is provided in a front end portion of the container 26, and at 35 a paint valve which is received in the paint valve accommodating portion 34. In this instance, the paint valve 35 is constituted by an air-piloted directional control valve, including a piston 35A which is slidably fitted in the paint valve accommodating portion 34 in such a way as to define a spring chamber and a pressure receiving chamber on its opposite sides, an elongated valve member 35B which is connected to the piston 35A at its base end and extended into the paint supply passage 28A of the feed tube 28 at its fore end to seat on and off the valve seat 28B, and a valve spring 35C which is provided in the spring chamber of the paint valve accommodating portion 34 and adapted to act on the valve member 35B through the piston member 35A urging the valve member 35C to seat on the valve seat 28B.

Normally, the valve member 35B of the paint valve 35 is seated on the valve seat 28B of the feed tube 28 under the influence of the biasing action of the valve spring 35C, thereby closing the paint supply passage 28A and suspending paint supply to the rotary atomizing head 20. On the other hand, as soon as pilot air is supplied to the pressure receiving chamber in the paint valve accommodating portion 34 from a pilot air source through a pilot air piping system (both not shown) via the pilot air passage 38 on the side of the housing and the pilot air passage 36 on the side of the paint cartridge, the valve member 35B is unseated from the valve seat 28B against the action of the valve spring 35C to start supply of paint from the paint reservoir chamber 30 to the rotary atomizing head 20. In this instance, one end of the pilot air passage 36 is opened in an inner peripheral surface of the female coupling portion 26B of the container 26, while the other end is communicated with the pressure receiving chamber of the paint chamber 34.

Indicated at 37 is a thinner passage which is provided on the side of the housing 12. The thinner passage 37 is extended axially through and within the neck portion 13 and bent backward in an L-shape at a position behind the female coupling portion 16B. One end of this thinner passage 37 on the side of the housing is connected to a thinner supply device (not shown), while the other end is opened in a bottom portion of the female coupling portion 16B on the cartridge mount portion 16. The angularly bent portion of the thinner passage 37 on the side of the housing is arranged to provide a valve seat 37A for seating and unseating a valve member 43B of a thinner valve 43 which will be described hereinafter.

Denoted at 38 is a pilot air passage which is provided on the side of the housing 12. One end of this pilot air passage 38 is connected to a paint valve pilot air source through pilot air piping (both not shown). The other end of the pilot air passage 38 is opened in a circumferential surface of the male coupling portion 16C, which is provided at the bottom 16A of the cartridge mount portion 16, at a position which confronts the pilot air passage 36 on the side of the paint cartridge.

Indicated at 39 is an air suction passage which is provided in the housing 12 and opened in the bottom portion 16A of the cartridge mount portion 16. This air suction passage 39 is connected to a vacuum source through vacuum piping (both not shown). This air suction passage 39 functions to suck air out of a vacuum space 40, which is formed at a deep portion of the cartridge mount portion 16 on the inner side of the container 26, to fix the paint cartridge 25 in the cartridge mount portion 16 with suction force.

Further, indicated at 41 is an ejection air supply passage which is provided in the housing 12 and opened at the bottom 16A of the cartridge mount portion 16. This ejection air supply passage 41 is connected to an ejection air source through air piping (both not shown). Through this ejection air passage 41, ejection air supplied to the vacuum space 40 to cancel the suction grip on the paint cartridge 25, thereby permitting to dismantle the paint cartridge 25 from the housing.

Indicated at 42 is a thinner valve accommodating portion which is provided in the head portion 14 of the housing 12, and at 43 a thinner valve which is provided in the thinner valve accommodating portion 42. In this instance, substantially in the same manner as the paint valve 35, the thinner valve 43 is arranged as an air-piloted directional control valve, including a piston 43A which is slidably fitted in the thinner valve accommodating portion 42 in such a way as to define a spring chamber and a pressure receiving chamber on its opposite sides, a valve member 43B which is connected to the piston 43A at its base end and extended into the thinner passage 37 on the side of the housing at its fore end to be seated on and off the valve seat 37A, and a valve spring 43C which is provided in the valve chamber of the thinner valve accommodating portion 42 and adapted to act on the valve member 43B through the piston 43A, urging the valve member 43B into a seated position.

Normally, the valve member 43B of the thinner valve 43 is seated on the valve seat 37A in the thinner passage 37 on the side of the housing under the influence of the biasing action of the valve spring 43C, thereby closing the thinner passage 37 to suspend thinner supply to the thinner chamber 31. On the other hand, as soon as pilot air is supplied to the pressure receiving chamber from the thinner valve pilot air source via pilot air piping (both not shown) and through the pilot air passage 44, the valve member 43B is unseated from the valve seat 37A against the action of the valve spring 43C to start thinner supply to the thinner chamber 31. In this instance, one end of the pilot air passage 44 is connected to the thinner valve pilot air source through pilot air piping, while the other end is communicated with the pressure receiving chamber of the thinner valve accommodating portion 42.

Figure 5:
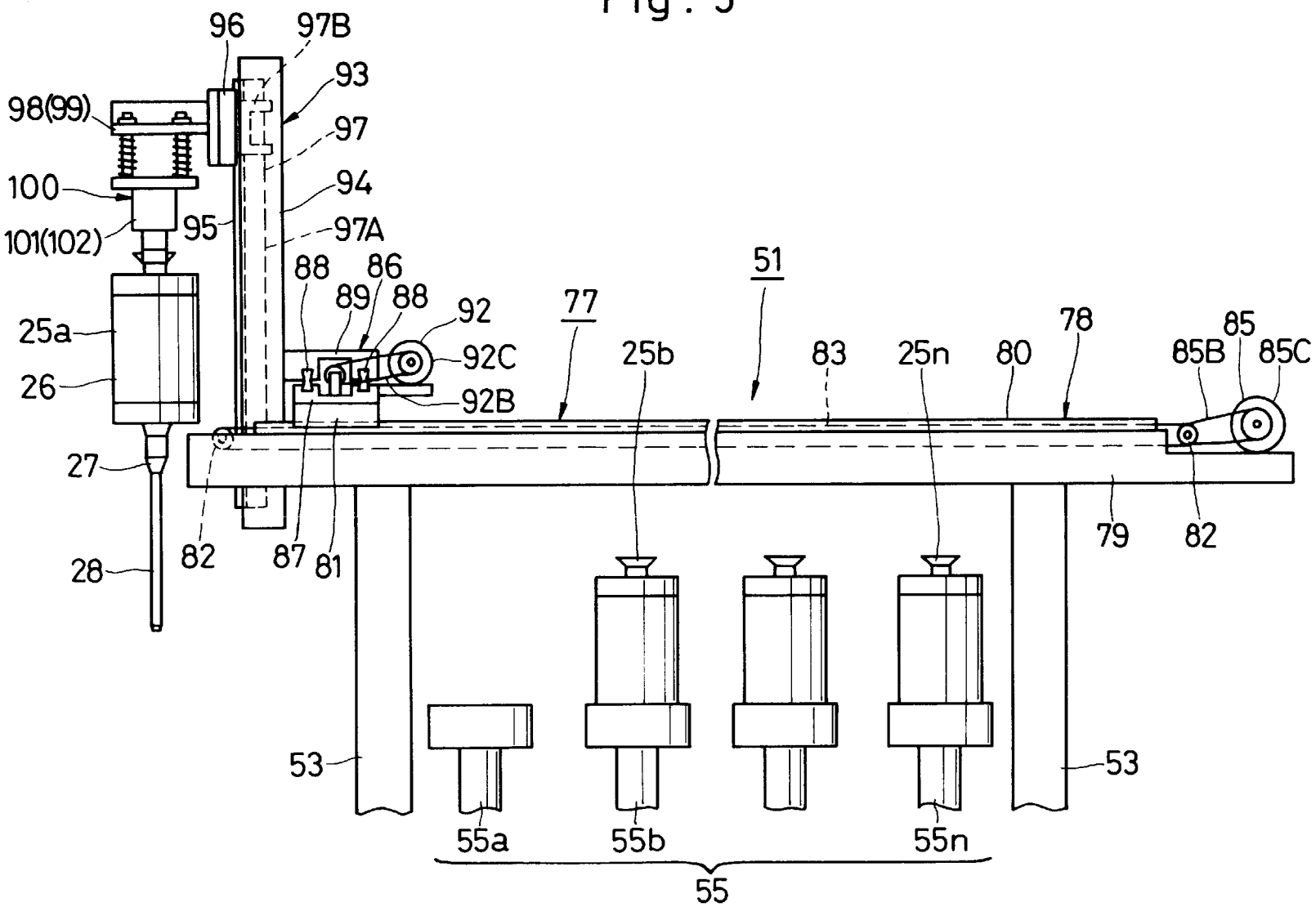
FIG. 5 is an enlarged front view of a cartridge changer shown in FIG. 1.
Figure 6:
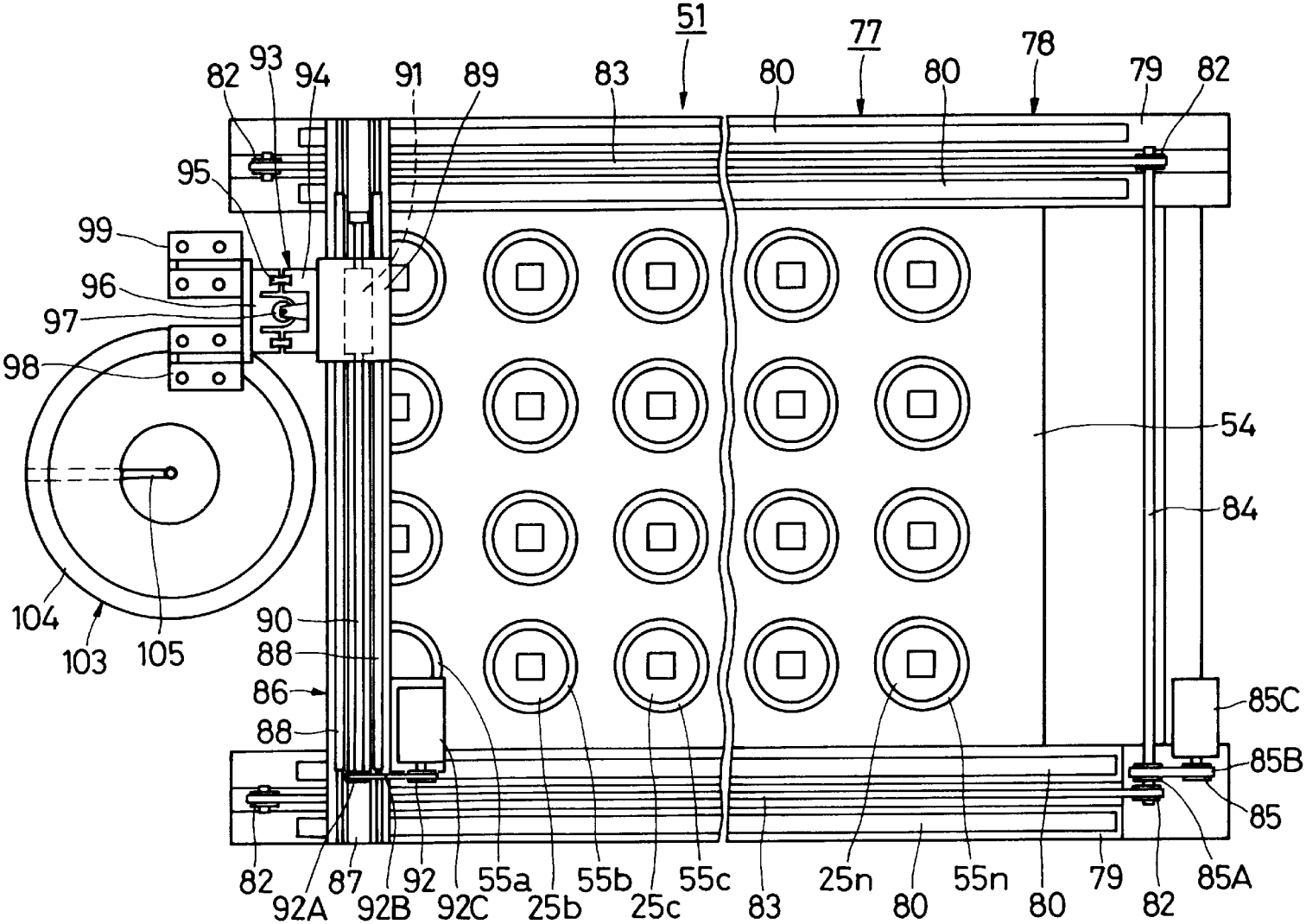
FIG. 6 is a plan view of the cartridge changer of FIG. 5.
Figure 7:
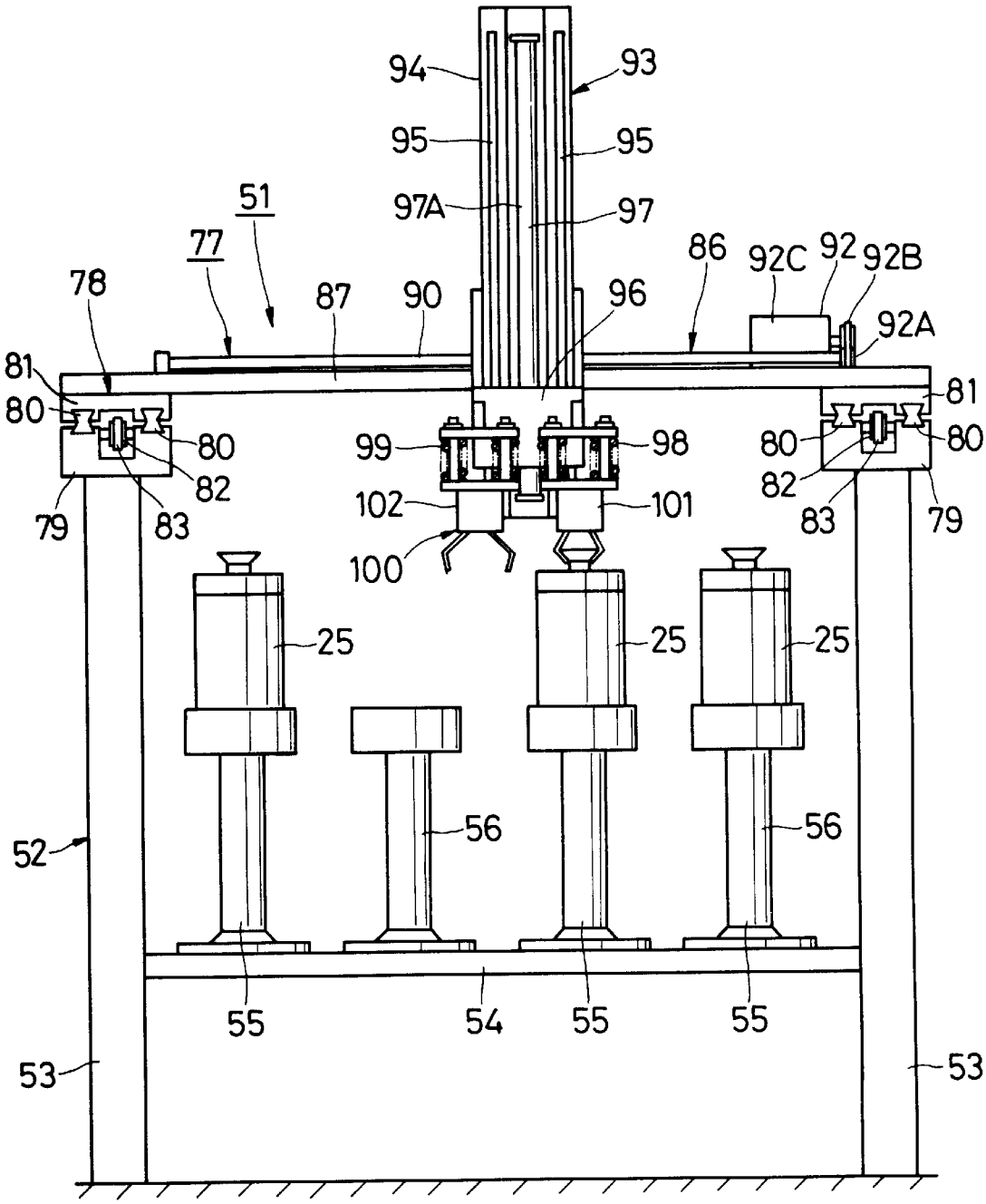
FIG. 7 is a left-hand side view of the cartridge changer of FIG. 5.

Referring now to FIGS. 5 to 7, there is shown a cartridge changer which is arranged to store a plural number of paint cartridges for different paint colors and to replaceably mount a selected one of the paint cartridges on the coating apparatus, in the manner as described below.

Namely, indicated at 51 is the cartridge changer according to the present embodiment of the invention. This cartridge changer 51 is located outside the working area of the coating robot 1 and in the vicinity of a washing apparatus 103 which will be described hereinafter. The cartridge changer 51 is largely constituted by a paint replenishers 55, a cartridge transfer system 77 and a cartridge gripper 100 as described below.

Indicated at 52 is a deck which provides a main frame structure of the cartridge changer 51, and which is largely constituted by four legs 53 which are erected in spaced positions in four corner portions of the rack, and a rectangular deck plate 54 which is supported on the legs 53 at its four corners and at vertically intermediate portions of the legs.

Indicated at 55*a*, 55*b*, . . . 55*n* are paint replenishers for paint colors a, b, . . . n (hereinafter referred to collectively as "paint replenisher 55" for brevity) which are provided on the rectangular deck plate 54 of the deck 52. As shown in FIG. 6, the paint replenishers 55 are arranged in rows and columns. Each one of the paint replenishers 55 are largely constituted, as will be described in greater detail hereinafter, by a replenishing stool 56, a feed tube passage hole 60 on the part of the replenishing stool, a connecting member 63, and a replenishing valve 65.

In this instance, the respective paint replenishers 55 are located under a longitudinal transfer mechanism 78 and a transverse transfer mechanism 86 of the cartridge transfer system 77 and outside a working area of the coating robot 1. Paint cartridges are handed over to and from the paint replenishers 55 and the coating apparatus 11 of the coating robot 1 by the cartridge transfer system 77, and each paint cartridge 25 is mounted into and dismantled from the housing 12 of the coating apparatus 11 by the cartridge gripper assembly 100 which is provided on a vertical lift mechanism 93.

Figure 8:
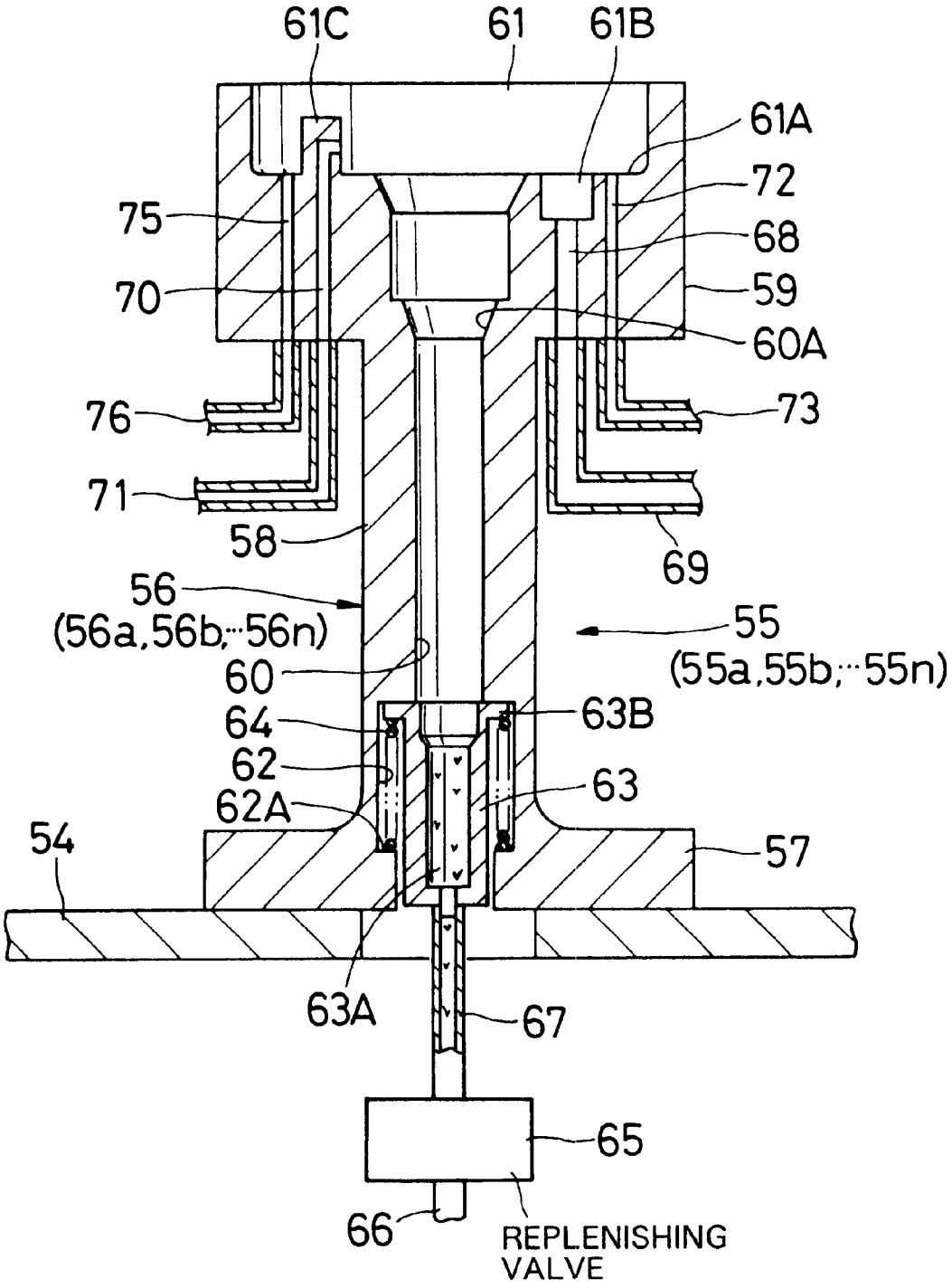
FIG. 8 is an enlarged vertical sectional view of a paint replenisher shown in FIG. 1.

Designated at 56*a*, 56*b*, . . . 56*n* are replenishing stools which constitute the respective paint replenishers 55 of different colors (hereinafter referred to collectively as replenishing stools 56). As shown in FIG. 8, each one of the replenishing stools 56 is largely constituted by a foot portion 57 which is fixed on the deck plate 54 of the deck 52 by the use of bolts or other fixation means, a column portion 58 which is extended vertically upward from the foot portion 57, and a seating block portion 59 which is formed by bulging an upper end portion of the column portion 58.

Indicated at 60 is the feed tube passage hole on the side of the replenishing stool, which is formed internally of and vertically through the column portion 58 of the replenishing stool 56 to receive therein the feed tube 28 of the paint cartridge 25. Provided at the upper end of the feed tube passage hole 60 on the part of the replenishing stool is an inwardly converging conical portion 60A which serves to hold the container 26 in position on the replenishing stool in axial and radial direction, by coupling engagement with the conical projection 27 at the fore end of the container 26.

Figure 9:
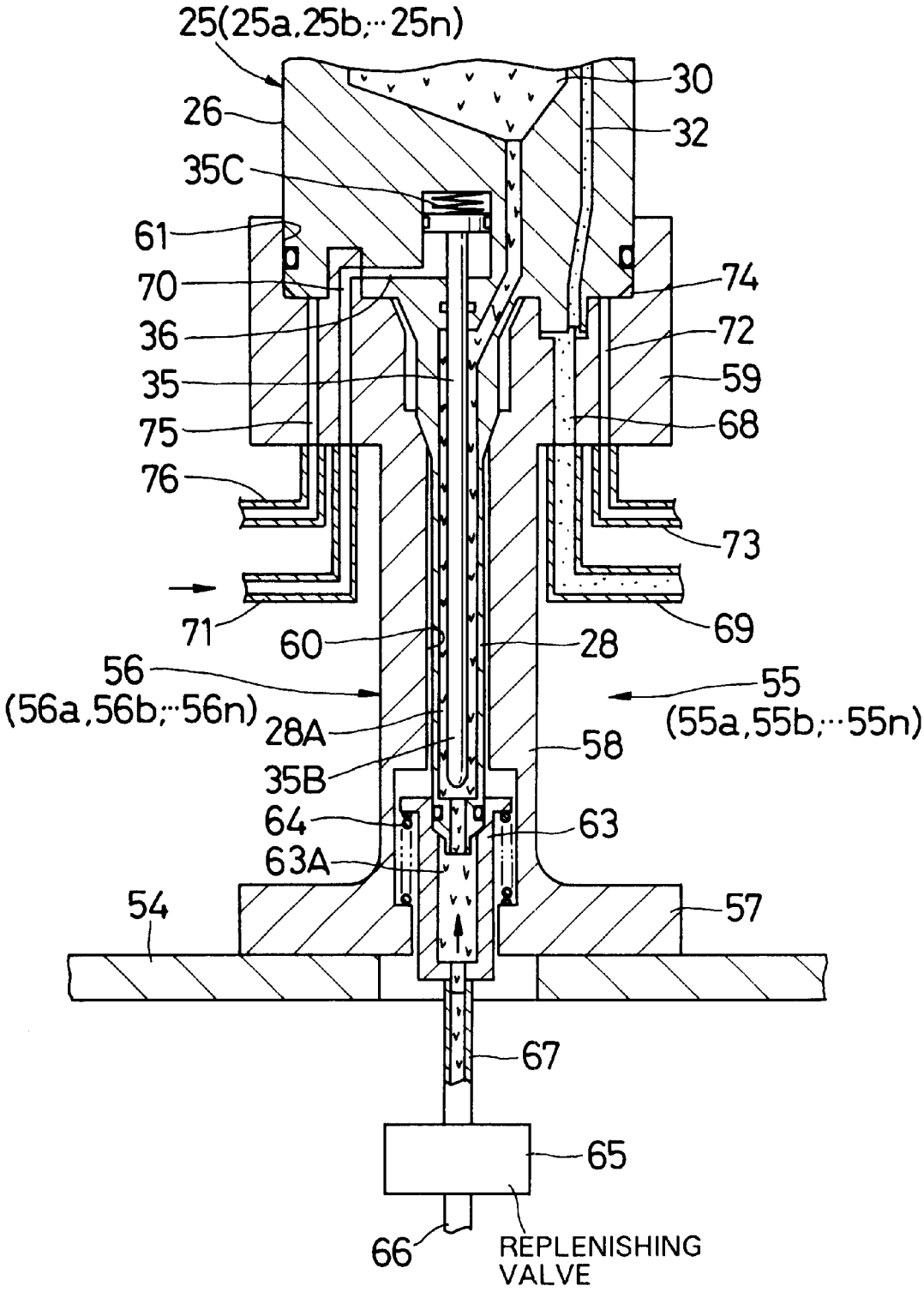
FIG. 9 is a vertical sectional view of the paint replenisher in an operational stage of replenishing a paint cartridge.

Indicated at 61 is the container support portion which is provided at one axial end (on the upper side) of the seating block portion 59 to support the container 26 of the paint cartridge 25 therein. This container support portion 51 is in the form of a recessed cylindrical cavity in communication with the upper open end of the feed tube passage hole 60 on the side of the replenishing stool. As seen in FIG. 9, female and male connector portions 61B and 61C are separately formed at the bottom 61A of the container support portion 61 for fitting engagement with the male and female coupling portions 26A and 26B on the part of the container 26, respectively. These female and male connector portions 61B and 61C serve to set the container 26 in a predetermined position in the circumferential direction when the container 26 is mounted on the container support portion 61.

Indicated at 62 is a connector receptacle bore which is formed in an axially opposite end portion of the replenishing stool 56, at a deeper position than the feed tube passage hole 60. Namely, the connector receptacle bore 62 is in the form of a cylindrical cavity which is formed by widening the diameter of a deeper portion of the feed tube passage hole 60. The lower end of the connector receptacle bore 62 is reduced in diameter in the downward direction through a stepped portion 62A.

Denoted at 63 is a connector member which is vertically movably provided in the connector receptacle bore 62. The connector member 63 is formed in the shape of a tube, which internally defines a paint passage 63A and which is provided with a flange-like spring seat 63B of an increased diameter at the upper end thereof. The paint passage 63A of the connector member 63 is brought into liquid-tight fitting engagement with a fore end portion of the feed tube 28 at the time of supplying paint into the container 26 through the feed tube 28. Further, the paint passage 63A is connected to a replenishing valve 65 through a hose 67 as will be described hereinafter.

Indicated at 64 is a coil spring which is provided around the outer periphery of the connector member 63. More particularly, the coil spring 64 is interposed between the spring seat 63B of the connector member 63 and the stepped portion 62A of the connector receptacle bore 62 to bias the connector member 63 in the upward direction toward the feed tube passage hole 60 on the side of the replenishing stool.

Thus, the connector member 63 is movable vertically in the upward and downward directions, and constantly urged toward the feed tube 28 by the biasing action of the coil spring 64. Therefore, even if the feed tube 28 is located in a deviated position in the upward or downward direction, the positional deviation of the feed tube 28 can be absorbed by an upward or downward movement of the connector member 63. Besides, by the action of the coil spring 64, the feed tube 28 can be securely brought into fitting engagement with the connector member 63.

Indicated at 65 is a replenishing valve which is connected to the connector member 63. The replenishing valve 65 is connected to a paint supply line (not shown) of a paint source on its upstream side through a paint conduit 66. The downstream side of the paint replenishing valve 65 is connected to the connector member 63 through a flexible paint hose 67 which constitutes a paint supply passage. The replenishing valve 65 is normally closed, and opened at the time of paint replenishment to a paint cartridge 25, permitting paint from the paint supply line to flow toward the connector member 63.

Indicated at 68 is a thinner discharge passage which is provided in the seating block portion 59 of the replenishing stool 56. This thinner discharge passage 68 is opened at one end thereof into the female coupling portion 61B of the container support portion 61, and connected at the other end to a thinner reservoir tank (not shown) through a thinner conduit 69. Through the thinner discharge passage 68, the thinner which flows out of the thinner chamber 31 of the paint cartridge 25 at the time of paint replenishment is discharged to the thinner reservoir tank.

Indicated at 70 is a pilot air passage on the side of the replenishing stool, which is provided in the seating block portion 59. One end of the pilot air passage 70 is connected to a paint valve pilot air source (not shown) through a pilot air conduit 71. The other end of the pilot air passage 70 is opened in a circumferential surface of the male coupling portion 61C of the container support portion 61 in a confronting position relative to the pilot air passage 36 on the side of the paint cartridge. Consequently, when the paint cartridge 25 is mounted on the container support portion 61 of the replenishing stool 56, the pilot air passage 70 on the side of the replenishing stool is communicated with the pilot air passage 36 on the side of the paint cartridge to supply pilot air from the paint valve pilot air source to the paint valve 35.

Indicated at 72 is an air suction passage which is provided in the seating block portion 59 and opened in a bottom portion 61A of the container support portion 61. This air suction passage 72 is connected to a vacuum source (not shown) through a vacuum conduit 73. Through the air suction passage 72, air is sucked out of a vacuum space 74 which is formed between a deep bottom portion of the container support portion 61 and the container 26 of the paint cartridge 25, so that the paint cartridge 25 is fixedly gripped in the container support portion 61 by suction force.

Designated at 75 is an ejection air supply passage which is also provided in the seating block portion 59 and opened in a bottom portion 61A of the container support portion 61. This ejection air supply passage 75 is connected to an ejection air source (not shown) through an air conduit 76. At the time of dismantling the paint cartridge 25 from the container support portion 61, air is supplied from the ejection air passage 75 to the vacuum space 74 thereby to release the paint cartridge 25 from the paint replenisher 56.

Indicated at 77 is a cartridge transfer system which is provided over the deck 52 to transfer a cartridge gripper unit 100, which will be described hereinafter, in the directions of three perpendicularly intersecting axes, namely, in longitudinal, transverse and vertical directions of the deck 52. For this purpose, the cartridge transfer system 77 is largely constituted by a longitudinal transfer mechanism 78, a transverse transfer mechanism 86 and a vertical transfer mechanism 93. By way of these three transfer mechanisms of the cartridge transfer system 77, a paint cartridge 25 is transferred and handed over to and from the paint replenisher 55 and the coating apparatus 11 which is mounted on the coating robot 1.

Designated at 78 is a first or longitudinal transfer mechanism which is mounted on top of the legs 53 of the deck 52. In this instance, as shown in FIGS. 5 to 7, the longitudinal transfer mechanism 78 is largely constituted by: front and rear rail support beams 79 which are extended in parallel relation between and securely fixed on right and left legs 53 on the front and rear sides of the arrayed paint cartridges 25 of the paint replenishers 55, respectively; a pair of longitudinal rails 80 which are provided on each one of the front and rear rail support beams 79; a couple of sliders 81 which are mounted on the longitudinal rail support beams 79 for movements longitudinally in the rightward and leftward directions on and along the longitudinal rails 80; a pair of pulleys 82 which are rotatably mounted on right and left end portions of each longitudinal rail support beam 79; elongated timing belts 83 which are respectively extended in the longitudinal direction and around the pulleys 82 and securely connected to the sliders 81 at a predetermined portion; a connecting rod 84 which is extended in the transverse direction to connect the pulleys 82 on the right ends of the rail support beams 79; and a drive mechanism 85 for moving the sliders 81 in the rightward and leftward directions along the rails 80.

In this instance, the drive mechanism 85 includes another pulley 85A which is mounted on the connecting rod 84, and a drive motor 85C which is connected to the pulley 85A through a short timing belt 85B.

According to the extent of rotation of the drive motor 85C of the drive mechanism 85, the sliders 81 of the longitudinal transfer mechanism 78 are moved through the timing belts 83 either in the rightward direction or in the leftward direction along the longitudinal guide rails 80. As a consequence, the cartridge gripper unit 100 is moved to the right or to the left through the transverse transfer mechanism 86 and the vertical transfer mechanism 93 which are supported on the respective sliders 81.

Indicated at 86 is the second or transverse transfer mechanism which is provided on the longitudinal transfer mechanism 78. In this instance, the transverse transfer mechanism 86 is largely constituted by: a transverse rail support beam 87 which is extended in the transverse direction and supported on the sliders 81 of the longitudinal transfer mechanism 78 at its opposite ends; a pair of transverse guide rails 88 which are provided on the transverse rail support beam 87; a slider 89 which is movably mounted on the transverse guide rails 88 for movements therealong; a male screw member 90 which is rotatably mounted on the transverse rail support beam 87 and extended between and along said transverse guide rails 88; a female screw member 91 which is mounted on the slider 89 and held in threaded engagement with said male screw member 90 through a large number of steel balls (not shown) to form a ball screw together with the male screw member 90; and a drive mechanism 92 for moving the slider 89 back and forth along the transverse guide rails 88.

In this instance, the drive mechanism 92 is constituted by a pulley 92A which is mounted on an end portion of the male screw member 90, and a drive motor 92C which is connected to the pulley 92A through a timing belt 92B.

According to the extent of rotation of the drive motor 92, the male screw member 90 is turned relative to the female screw member 91 to move the slider 89 along the transverse guide rails 88 of the transverse transfer mechanism 86. Accordingly, the transverse transfer mechanism 86 moves the cartridge gripper assembly 100 in a transverse direction through the vertical transfer mechanism 93 which is mounted on the slider 89.

Indicated at 93 is the third or vertical transfer mechanism which is mounted on the transverse transfer mechanism 86. In this instance, the vertical transfer mechanism 93 is largely constituted by: a post 94 which is fixedly attached to the slider 89 of the transverse transfer mechanism 86 and extended in vertical direction; a pair of vertical guide rails 95 which are provided on the post 94; a slider 96 which is movably mounted on the vertical guide rails 95 for movements therealong; and a drive mechanism 97 for moving the slider 96 along the vertical guide rails 95.

In this instance, the drive mechanism 97 is largely constituted by a piston-cylinder 97A which is mounted on the post 94 and internally provided with a free piston (not shown) for sliding movements therein; and a lift member 97B which is provided on the outer peripheral side of the cylinder 97A and adapted to move up and down following movement of the free piston. The lift member 97B is connected to the slider 96. In this manner, the drive mechanism 97 is arranged as a rodless cylinder which can stop the slider 96 in predetermined upper and lower positions.

Thus, the slider 96 of the vertical transfer mechanism 93 is moved in upward and downward directions along the vertical guide rails 95 as the lift member 97B of the drive mechanism 97 is moved along the cylinder 97A. As a consequence, the cartridge gripper assembly 100 which is attached to the slider 96 is moved vertically in the upward or downward direction along with the slider 96 of the vertical transfer mechanism 93.

Figure 10:
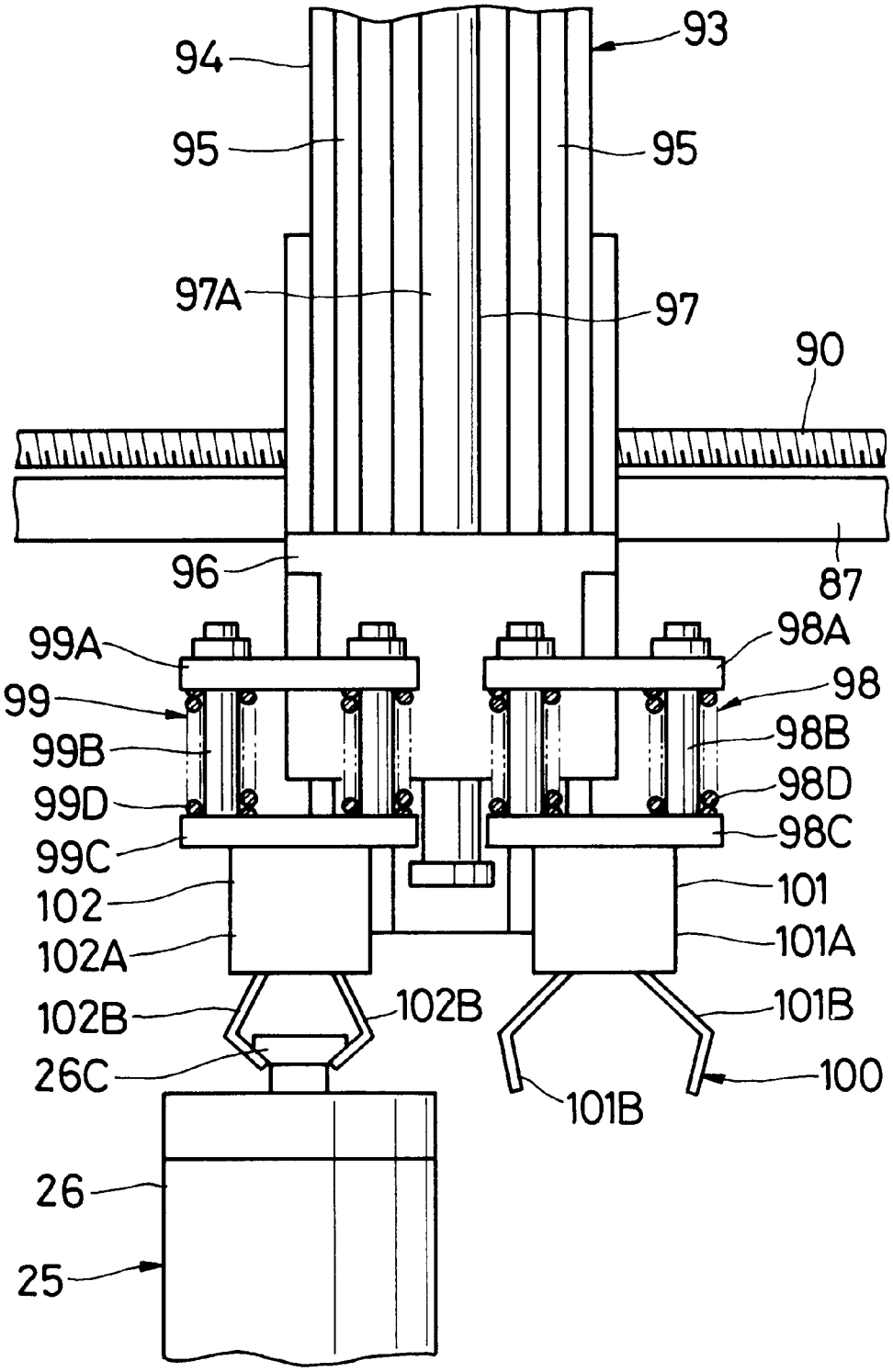
FIG. 10 is an enlarged schematic view of a cartridge gripper shown in FIG. 7.

Indicated at 98 is one shock absorber which is constituted, as shown in FIG. 10, by a rectangular top plate 98A which is projected froward from the front side of the slider 96, four rod members 98B which are pendant from the top plate 98A and are loosely fitted in the top plate 98A for vertical movements relative to the latter, a bottom plate 98C which is securely fixed to lower ends of the rod members 98B, and coil springs 98D which are fitted around the rod members 98B between the top and bottom plates 98A and 98C. Attached to the bottom plate 98C is one of gripper members 101 of the cartridge gripper assembly 100.

Further, indicated at 99 is the other shock absorber which is provided side by side with the above-described one shock absorber 98. Similarly to the first-described shock absorber 98, the other shock absorber 99 is constituted by top plate 99A, rod members 99B, bottom plate 99C and coil springs 99D. Attached to the bottom plate 99C is the other one 102 of the gripper members of the cartridge gripper assembly 100.

The shock absorbers 98 and 99 are located between the vertical transfer mechanism 93 and the gripper members 101 and 102 of the cartridge gripper assembly 100. Therefore, at the time when the grippers 101 and 102 are lowered toward and abutted against paint cartridges 25 by the vertical transfer mechanism 93, the shock absorbers 98 and 99 permit upward displacements of the grippers 101 and 102 to buffer impacts of abutting contact. In addition, the shock absorbers 98 and 99 permit downward displacements of the grippers 101 and 102 to absorb relative positional deviations of paint cartridges 25, if any.

The cartridge gripper assembly 100 is mounted on the vertical transfer mechanism 93 through the shock absorbers 98 and 99 as cartridge gripper means, and largely constituted by a couple of gripper members 101 and 102 to simultaneously grip a couple of paint cartridges 25 side by side.

Indicated at 101 is one of the gripper members, which is supported on the vertical transfer mechanism 93 through one shock absorber 98. This one gripper member 101 is attached to the bottom plate 98C of one shock absorber 98, and largely constituted by a drive section 101A which has an actuator (not shown) built into its housing, and a pair of gripper claws 101B which are provided in the drive section 101A and adapted to be moved toward and away from each other by the actuator. The gripper claws 101B of the first gripper member 101 are moved toward or away from each other by the actuator of the drive section 101A at the time of gripping or releasing a knob portion 26C of a container 26.

The other or second gripper member 102 which is provided wide by side with the first gripper member 101 is similarly constituted by a drive section 102A which is mounted on the lower side of the bottom plate 99C of the other shock absorber 99, and a pair of gripper claws 102B which are provided on the drive section 102A.

On the other hand, indicated at 103 is a washer which is located within a working area of the coating robot 1 and in the vicinity of the cartridge changer 51, for the purpose of washing clean the rotary atomizing head 20. In this instance, the washer 103 is largely constituted by a waste liquid recovering container 104 to be located under the coating apparatus 11 when the coating apparatus 11 is moved to a predetermined cartridge replacing position, and washing nozzles 105 which is provided within the waste liquid recovering container 104 to spurt out a wash liquid toward the rotary atomizing head 20 in a washing step of a coating operation.

More particularly, after the coating apparatus 11 is located in a cartridge replacing position of the cartridge changer 51 and the housing 12 of the coating apparatus 11 is located within the waste liquid recovering container 104, a wash fluid is spurted toward the front end of the rotary atomizing head 20 from the washing nozzles 105 of the washer 103.

With the arrangements as described above, the automatic coating apparatus according to the present embodiment can perform coating and cartridge (color) changing operations automatically, in the manner as described below with reference to FIGS. 11 through 18 and to the time chart of FIG. 19. In the operational conditions as illustrated in FIGS. 11 through 18, the two grippers 101 and 102 are located in overlapping positions and only one of the two grippers 101 and 102, which is on the proximal side, is visible. However, the two grippers 101 and 102 are shown separately in these figures for the purpose of explaining movements of the respective grippers.

Firstly, in the case of a coating operation, the automatic coating apparatus is operated according to an uploaded coating program, which specifies the order of paint colors to be used in the coating operation. Therefore, concurrently with a coating operation with a first paint color, the cartridge changer 51 is operated to pick up a replenished paint cartridge 25 of a next color from the paint replenisher 55 to attain higher efficiency of cartridge replacing work.

Figure 11:
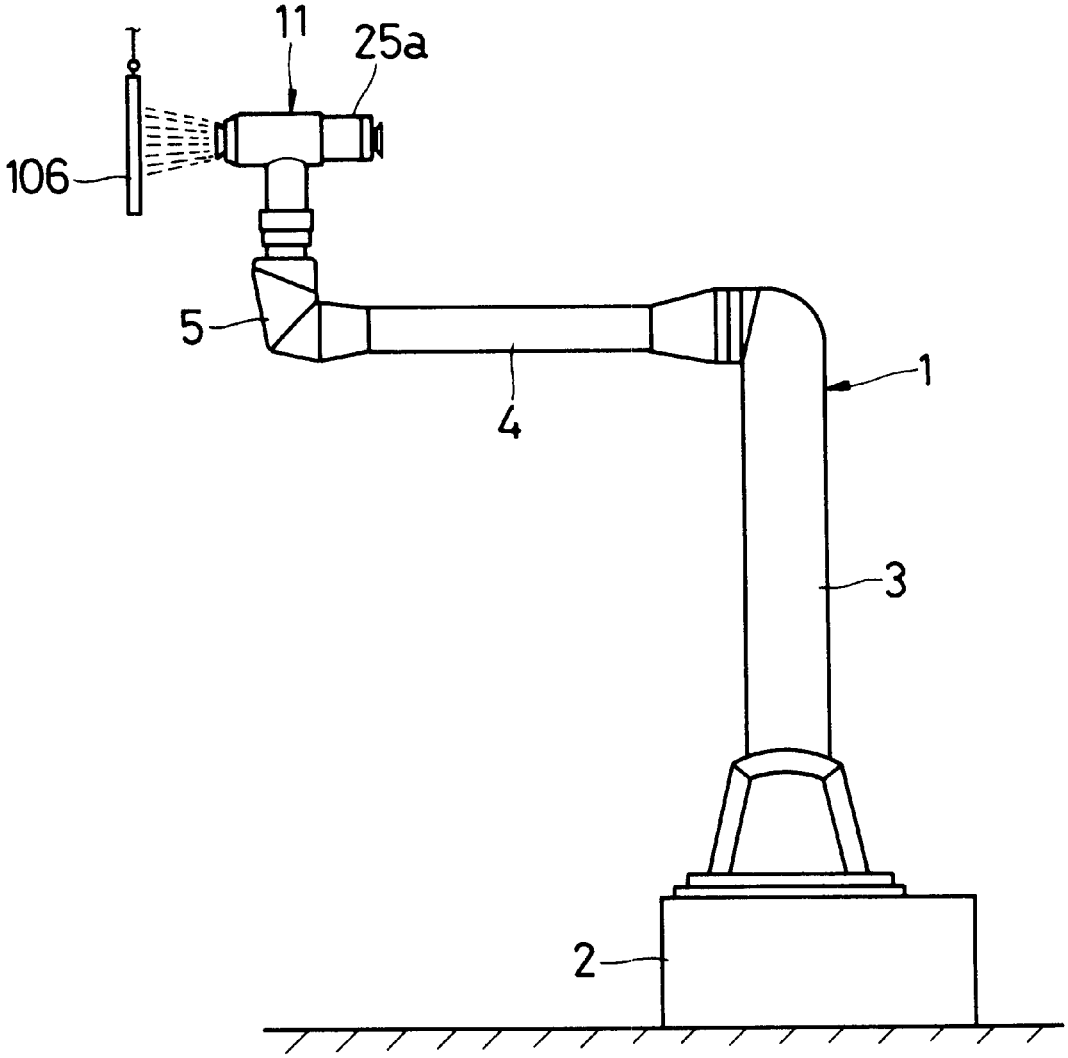
FIG. 11 is a schematic illustration explanatory of a coating operation by the coating apparatus.

Firstly, in a coating step, the arms 3 and 4 of the coating robot 1 are operated as shown in FIG. 11 to turn the coating apparatus 11 with a paint cartridge 25*a* of color a, for example, toward a coating object 106. In this state, the air motor 19 is actuated, thereby putting the rotary atomizing head 20 in high speed rotation, spurting out shaping air through the shaping air outlet holes 21A on the shaping air ring 21, and applying a high voltage to the paint from the high voltage generator 22. Then, thinner is supplied as a paint extruding liquid quantitatively to the thinner chamber 31 in the container 26, thereby pushing forward the piston 29 to supply the paint of color a from the paint reservoir chamber 30 to the rotary atomizing head 20 through the feed tube 28. As a result, the paint is sprayed in finely atomized particles from the rotary atomizing head 20 toward the coating object 106.

Now, in order to change to paint color from a to b, the cartridge changer 51 is operated to pick up a replenished paint cartridge 25*b* of next color b concurrently with a coating operation with a preceding color a as mentioned hereinbefore.

In the step of picking up a replenished paint cartridge of a next color, the longitudinal and transverse transfer mechanisms 78 and 86 of the cartridge changer 51 to locate one gripper member 101 of the cartridge gripper assembly 100, which is supported on the vertical transfer mechanism 93, in a position over the paint cartridge 25*b* which is supported on the replenishing stool 56*b* of the paint replenisher 55*b*. Then, the vertical transfer mechanism 93 is operated to lower the gripper member 101 along with the slider 96 toward the paint cartridge 25*b* and to grip the knob portion 26C of the paint cartridge 25*b* by the gripper claws 101B of the gripper member 101.

When the cartridge gripper assembly 100 is lowered by the vertical transfer mechanism 93 as described above, one gripper member 101 is abutted against the paint cartridge 25*b*. At this time, however, one shock absorber 98 buffers the impacts of abutment by letting the gripper member 101 move in the upward direction. The shock absorber 98 which permits vertical upward or downward movement of the gripper member 101 also contributes to absorb a vertical positional deviation of the paint cartridge 25*b*, if any. The same applies to the other shock absorber 99 as well as the other gripper member 102.

Figure 12:
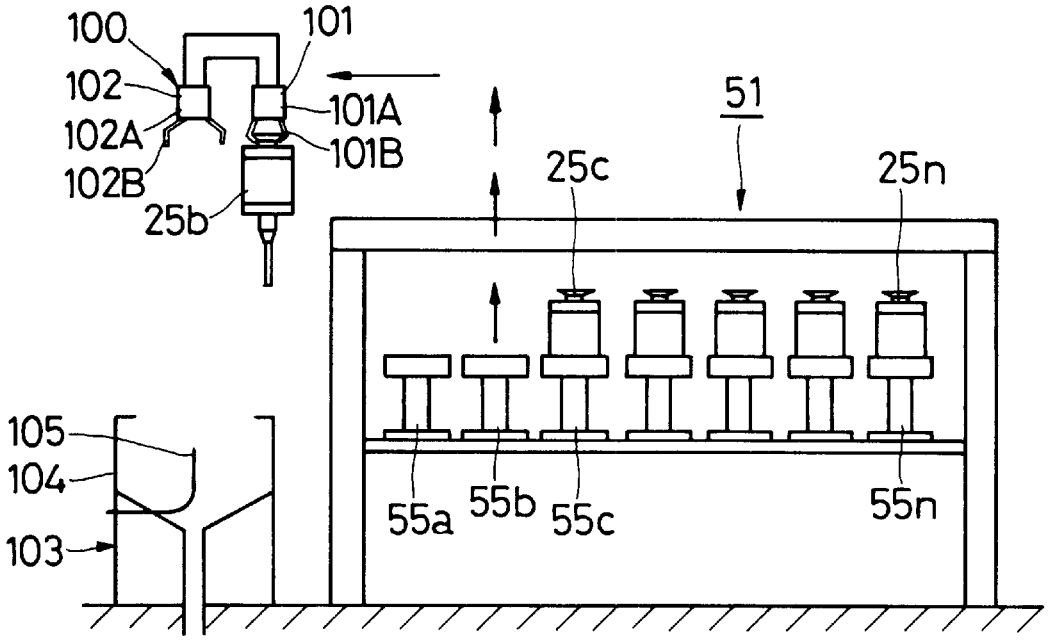
FIG. 12 is a schematic illustration explanatory of an operation of picking up a replenished paint cartridge from the paint replenisher.

As soon as the paint cartridge 25*b* is gripped by one gripper member 101, the cartridge gripper assembly 100 is lifted up by the vertical transfer mechanism 93. As a result, the replenished paint cartridge 25*b* is picked up from the replenishing stool 56*b* by one gripper member 101. Then, through the longitudinal and transverse transfer mechanisms 78 and 86, the gripper member 101 which grips the replenished paint cartridge 25*b* of color b in one gripper member 101 is further transferred until the other gripper member 102 is located in a standby position over the washer 103 as shown in FIG. 12.

Figure 13:
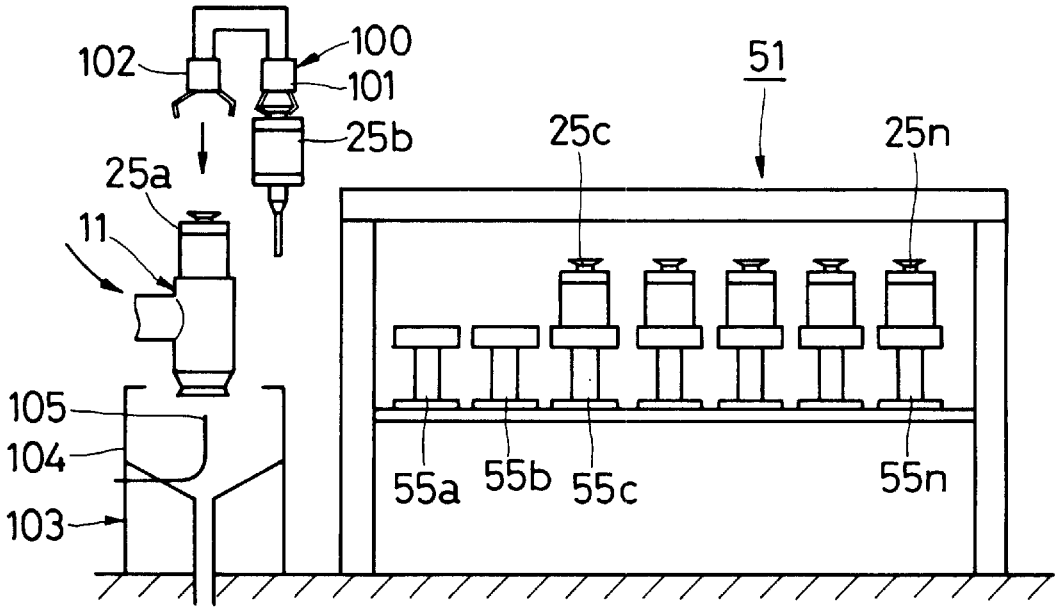
FIG. 13 is a schematic illustration explanatory of an operation of locating the coating apparatus to a cartridge changing position by the cartridge changer.

A step of coating color a is followed by a washing step to wash off deposited color a from the coating apparatus 11. For this purpose, as shown in FIG. 13, the coating robot 1 is operated to move the coating apparatus 11 to a position above the washer 103, thereby putting the rotary atomizing head 20 of the coating apparatus 11 in the waste liquid recovering container 104 of the washer 103. As a result, the coating apparatus 11 is located in a cartridge replacing position over the washer 103.

Figure 14:
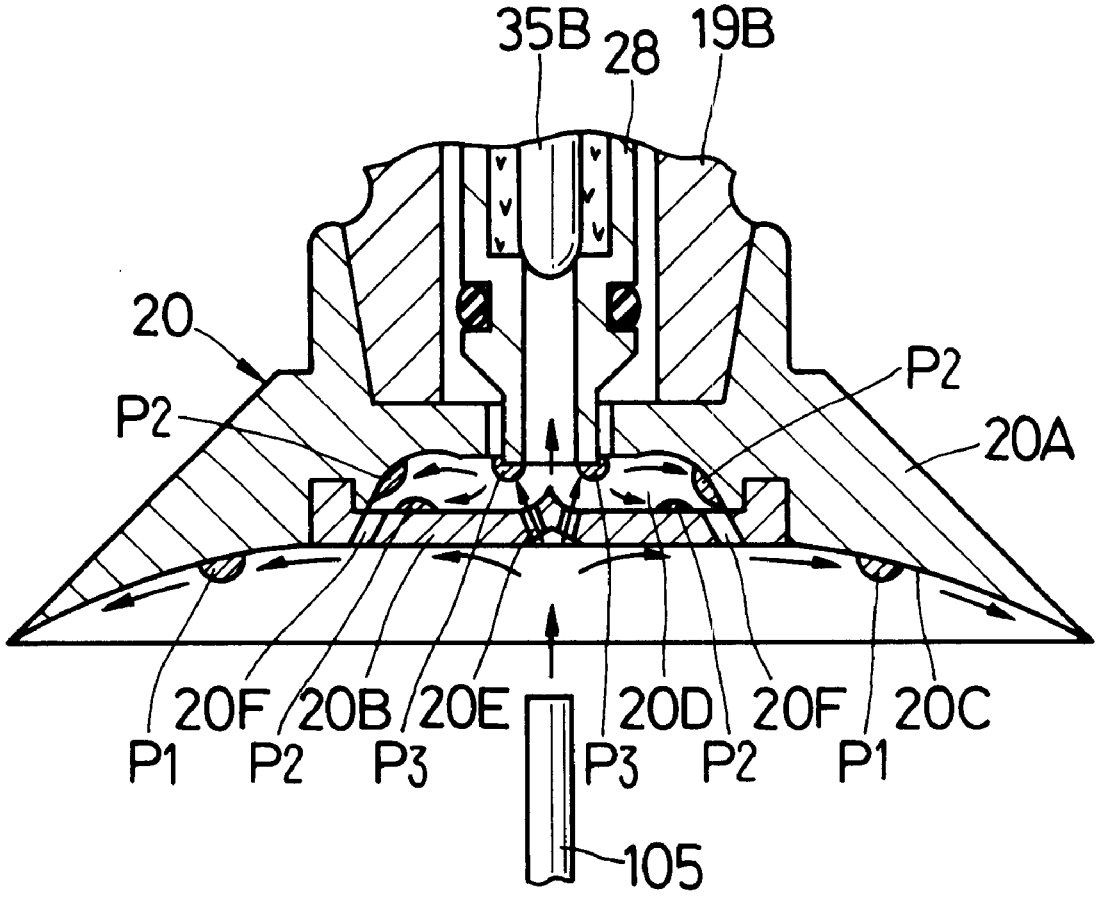
FIG. 14 is a schematic illustration explanatory of an operation of washing the rotary atomizing head and a fore end portion of a feed tube by an atomizing head washer.

Then, the fore end of the coating apparatus 11 on the side of the rotary atomizing head 20 is inserted into the waste liquid recovering container 104 of the washer 103 to wash the rotary atomizing head 20 clean. In this washing step, as shown in FIG. 14, a wash fluid is spurted out from the respective washing nozzles 105 to wash away deposited previous color a from fore end portions of the housing 12 and rotary atomizing head 20.

As a consequence, the wash fluid which is spurted out from the wash nozzles 105 is supplied to the front side of the rotary atomizing head 20 to wash off deposited paint P1 of color a from the paint spreading surfaces 20C. Further, part of the wash fluid is allowed to flow into the paint reservoir 20D through the respective wash fluid inlet holes 20E to wash off deposited paint P2 of color a on inner wall surfaces of the bell cup 20A as well as deposited paint P3 of color a on fore end portions of the feed tube 28.

At the end of the washing step, after washing off the previous color a, air is supplied to the vacuum space 40 between the housing 12 and the paint cartridge 25*a* to cancel the suction air grip on the paint cartridge 25*a*.

Figure 15:
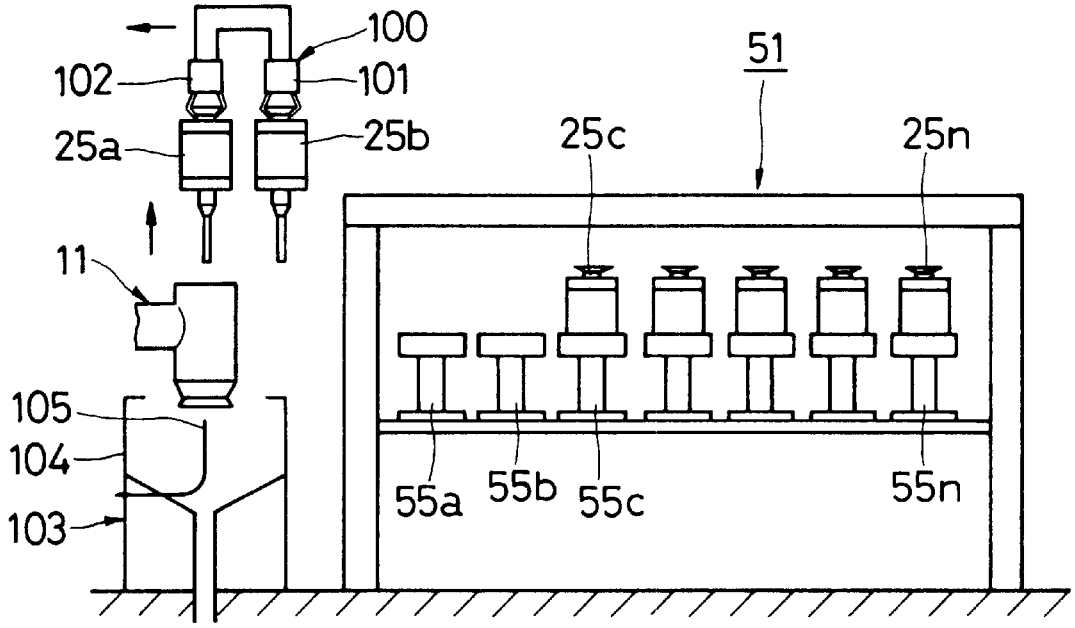
FIG. 15 is a schematic illustration explanatory of an operation of dismantling an empty paint cartridge from the coating apparatus.

Following the above-described washing step is an empty paint cartridge unloading step as shown in FIG. 15, in which the empty paint cartridge 25*a* is unloaded from the housing 12. More specifically, in this step, the cartridge gripper assembly 100 which grips the replenished paint cartridge 25*b* in one gripper member 101 is lowered by the vertical transfer mechanism 93 to grip the empty cartridge 25*a* on the coating apparatus 11 in the other gripper member 102. In this state, the cartridge gripper assembly 100 is lifted up by the vertical transfer mechanism 93 as shown in FIG. 15 to extract the empty paint cartridge 25*a* out of the housing 12 of the coating apparatus 11 by the other gripper member 102.

Figure 16:
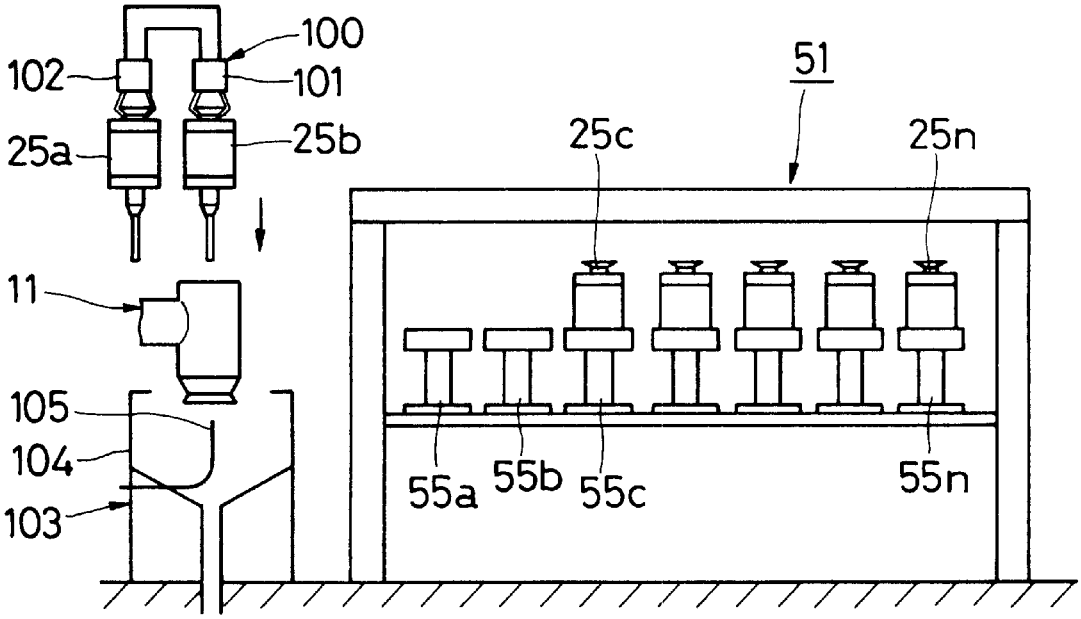
FIG. 16 is a schematic illustration explanatory of an operation of positioning a replenished paint cartridge over the coating apparatus.

After removing the empty paint cartridge 25*a* from the housing 12 in this manner, the cartridge gripper assembly 100 is moved in a transverse direction by the transverse transfer mechanism 86 as shown in FIG. 16 to locate the replenished paint cartridge 25*b* in one gripper member 101 in a position above the cartridge mount portion 16 of the housing 12.

Figure 17:
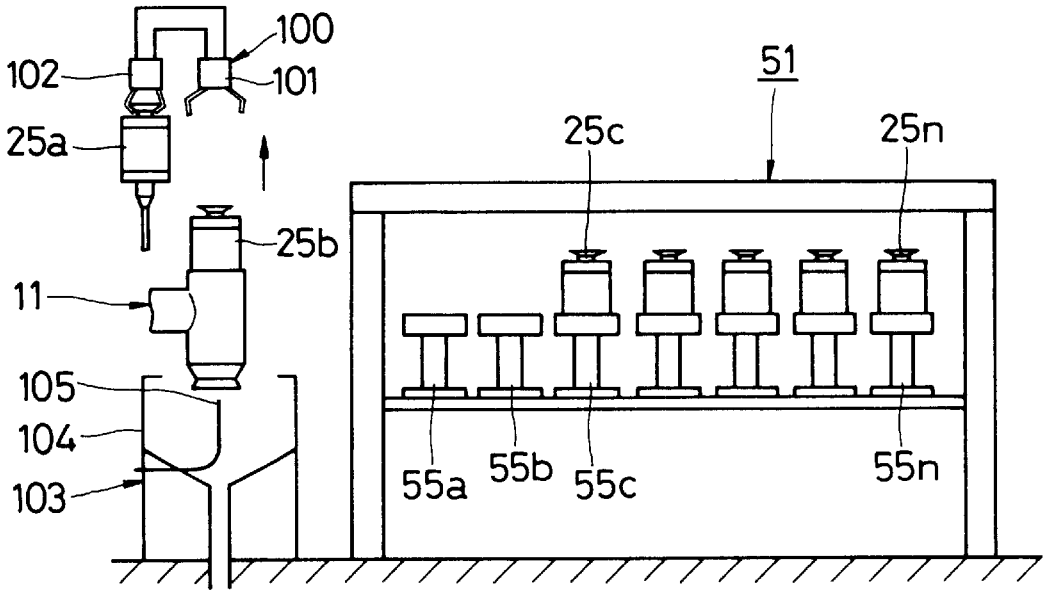
FIG. 17 is a schematic illustration explanatory of an operation of mounting the replenished paint cartridge on the coating apparatus.

The empty paint cartridge unloading step is followed by a replenished cartridge loading step as illustrated in FIG. 17. In the replenished paint cartridge loading step, the cartridge gripper assembly 100 which still grips the empty cartridge 25*a* in the other gripper member 102 is lowered by the vertical transfer mechanism 93. As a result, as seen in FIG. 17, the replenished paint cartridge 25*b* which is gripped in one gripper member 101 is fitted and set in the cartridge mount portion 16 of the housing 12. At this time, air in the vacuum space 40 is sucked out through the air suction passage 39 to grip the paint cartridge 25*b* fixed in the housing 12 by vacuum force.

Figure 18:
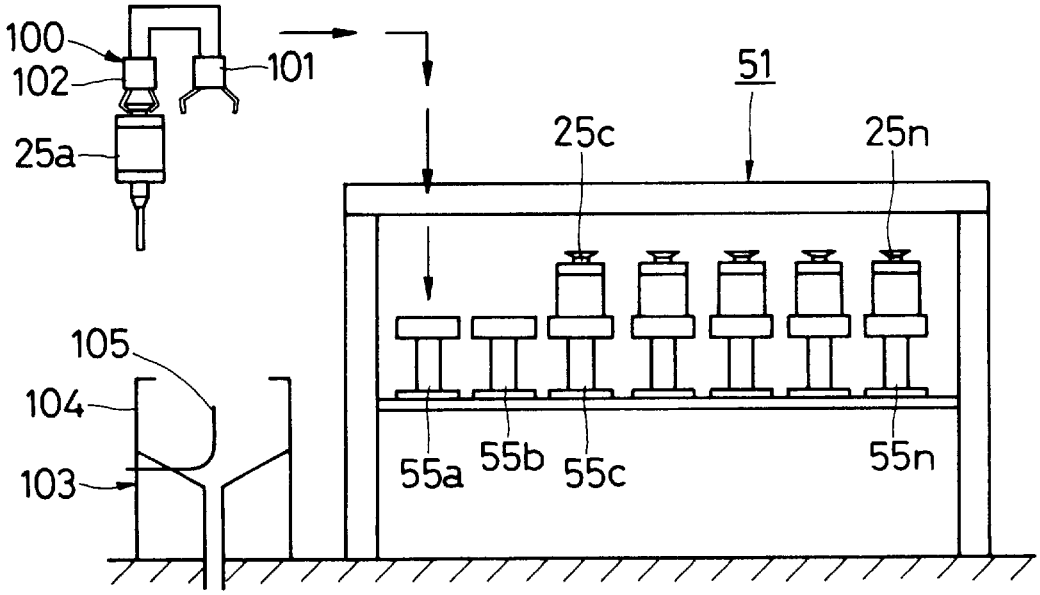
FIG. 18 is a schematic illustration explanatory of an operation of returning a dismantled empty paint cartridge to the paint replenisher.
Figure 19:
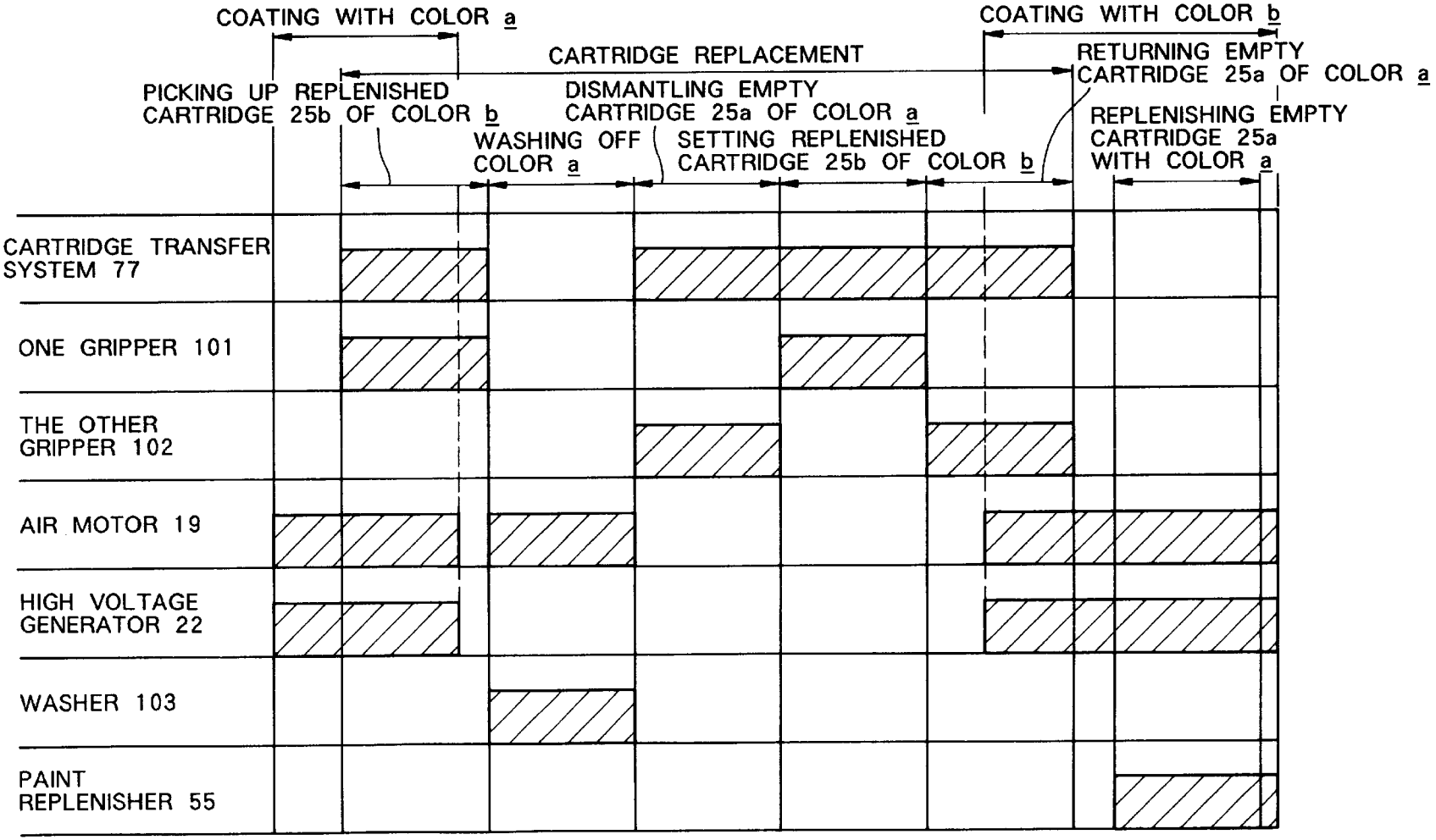
FIG. 19 is an operational time chart of the cartridge changer.

As soon as the paint cartridge 25*b* of color b is loaded in the cartridge mount portion 16 of the coating apparatus 11, the operation advances to an empty paint cartridge returning step as illustrated in FIG. 18. In the empty paint cartridge returning step, the empty paint cartridge 25*a* which has been unloaded from the coating apparatus 11 is returned to a replenishing stool 56*a* of the paint replenisher 55*a* as shown in FIG. 18. At this time, the feed tube 28 of the empty paint cartridge 25*a* is placed in the feed tube passage hole 60 on the side of the replenishing stool, and its container 26 is set on the container support portion 61 of the stool.

Further, a fore end portion of the feed tube 28 is fitted into the connector member 63 and therefore becomes communicable with the paint hose 67.

In the meantime or concurrently with the empty paint cartridge returning step, a coating operation is carried out by the coating apparatus 11 which is loaded with the replenished paint cartridge 25*b* of color b. Therefore, the coating apparatus 11 with the fresh and replenished paint cartridge 25*b* is moved to a coating standby position by the coating robot 1 to start coating in color b as soon as a coating object 106 is transferred to a predetermined position.

Now, the description is directed to a paint replenishing step of the operation. In this step, paint is replenished into a cartridge immediately before a coating operation by that cartridge for the purpose of preventing separation and sedimentation of pigment components in the paint. Therefore, the timing for starting replenishment varies widely depending upon the frequency at which a particular paint color is used or other factors. In this particular embodiment, a paint replenishing operation is started by way of example at a time interval from the end of the empty paint cartridge returning step as described above.

The paint replenishing step is started by opening the replenishing valve 65 of the paint replenisher 55*a* as shown in FIG. 9 to supply and replenish paint of color a into the container 26 of the paint cartridge 25*a* through the paint hose 67 and the paint passage 63A of the connector member 63 and through the fore end of the feed tube 28.

In this manner, according to the present embodiment, for example, a replenished paint cartridge 25*b* of a next color b is gripped in one gripper member 101 prior to cartridge replacement. Therefore, the replenished paint cartridge 25*b* on one gripper member 101 can be loaded on the coating apparatus 11 immediately after unloading the empty paint cartridge 25*a* from the coating apparatus 11 by the other gripper member 102. It follows that, in replacing the paint cartridge 25, it suffices for the cartridge transfer system 77 to reciprocate the cartridge gripper assembly 100 between the paint replenisher 55 and the coating apparatus 11 just for once each time. Therefore, it becomes possible to shorten the time period required for the cartridge replacement, and to enhance the productivity.

Besides, the cartridge changer 51 is constituted by the paint replenishers 55*a*, 55*b*, . . . 55*n* which are arranged to support the paint cartridges 25*a*, 25*b*, . . . 25*n* of various colors in rows and columns, the cartridge transfer system 77 which is located above the paint replenisher 55 and adapted to transfer the paint cartridge 25 along three perpendicular axes in longitudinal, transverse and vertical directions, and the cartridge gripper assembly 100 which is provided on the cartridge transfer system 77 and adapted to pick up replenished and empty paint cartridges. Thus, the cartridge changer 51 has the paint cartridges 25 located efficiently in rows and columns so that it can be reduced in size and installed compactly in a small space. Besides, since the cartridge gripper assembly 100 is moved by the cartridge transfer system 77, smaller motors can be used for the drive motors 85C and 92C for the purpose of cost reductions.

In addition, the cartridge changer 51 utilizes the stools 56 of the respective paint replenishers 55 as seats for the paint cartridges 25. Therefore, when an empty paint cartridge 25 is returned to the cartridge changer 51, it can be replenished with paint by a paint replenisher 55 without a need for a transfer, for example, to a separately located paint replenisher.

Further, the vertical transfer mechanism 93 is provided with the shock absorbers 98 and 99 on the slider 96, so that, as the gripper members 101 and 102 of the cartridge gripper assembly 100 are lowered and abutted against the paint cartridge 25, the impacts of abutment are buffered by the shock absorbers 98 and 99 to lessen abrasive wear or damages and to enhance the durability of contacting parts. Additionally, since the shock absorbers 98 and 99 can absorb deviations in vertical position of the cartridge 25, the vertical transfer mechanism 93 suffices to be a two-position control type which is less costly.

Further, the washer 103 for washing the rotary atomizing head 20 of the coating apparatus 11 is located at a cartridge replacement position of the cartridge exchanger 51, so that deposited previous color on the rotary atomizing head 20 can be washed off at the time of each cartridge replacement in such a way as to enhance working efficiency.

Although in the foregoing embodiment the rotary atomizing head type coating apparatus 11 is mounted on the coating robot 1 which is typical of working mechanisms, it is to be understood that the present invention is not limited to the particular arrangement shown. For example, the coating apparatus 11 may be mounted on a reciprocator or other working mechanisms if desired.

Further, in the foregoing embodiment, the cartridge transfer system 77 is systematically provided with transfer mechanisms for transferring the cartridge gripper assembly 100 in the longitudinal, transverse and vertical directions, including the longitudinal transfer mechanisms 78, the transverse transfer mechanism 86, and the vertical transfer mechanism 93 which is supported on the transverse transfer mechanism 86. However, in this regard, it is to be understood that the present invention is not restricted to the particular arrangements shown. For example, there may be employed a modified cartridge transfer system, in which the longitudinal transfer mechanism is mounted on the transverse transfer mechanism and the vertical transfer mechanism is mounted on the longitudinal transfer mechanism.

Further, although in the foregoing embodiment thinner is employed for pushing the piston 29 in the paint cartridge 25. However, water or other extruding liquid may be employed depending upon properties of paint or upon the type of the high voltage application system.

On the other hand, to cope with coating operations in which one and same color is coated continuously, the cartridge changer may be modified to hold two or more paint cartridges 25 for each color or for a particular color.

INDUSTRIAL APPLICABILITY

As described in detail hereinbefore, the automatic coating method according to the present invention is comprised of: coating step of a coating object by a coating apparatus loaded with a replenished paint cartridge and operated through a working mechanism; a step of picking up a replenished paint cartridge of a color to be used in a next coating operation from a paint replenisher means by the use of one of gripper members of a cartridge gripper means; a step of unloading an empty paint cartridge from the coating apparatus by the use of the other one of the gripper members of the gripper means with the replenished paint cartridge still gripped in one gripper member; a step of loading the replenished paint cartridge on the coating apparatus by one gripper member of the cartridge gripper means with the empty paint cartridge on the other gripper member; and a step of returning the unloaded empty paint cartridge to a paint replenisher. Accordingly, an empty paint cartridge on the coating apparatus can be replaced by a replenished paint cartridge in an efficient manner, i.e., by reciprocating the cartridge gripper means only for once between the coating apparatus and a paint replenishing means.

Further, as described hereinbefore, the automatic coating apparatus according to the present invention employs a cartridge changer, which is comprised of: a paint replenishing means having a number of paint replenisher units for different paint colors, each adapted to support and replenish a paint cartridge of a corresponding color; a cartridge transfer means adapted to transfer paint cartridges in the directions of three perpendicularly intersecting axis; and a cartridge gripper means supported on the cartridge transfer means and adapted to grip and transfer paint cartridges between the coating apparatus and the paint replenishing means. Therefore, when the coating apparatus with an empty or consumed paint cartridge is located at a predetermined cartridge replacing position for cartridge replacement after finishing a coating operation in one color, the cartridge gripper means is moved by the cartridge transfer means to hand over a paint cartridge to and from the coating apparatus and the paint replenishing means. In addition, the empty paint cartridge is supported by and replenished with paint by the paint replenishing means in preparation for next use.

What is claimed is:

1. An automatic coating method using a working mechanism located in a coating area, a coating apparatus mounted on said working mechanism and adapted to be replaceably loaded with paint cartridges of various colors, and a cartridge changer including a paint replenishing means for replenishing paint into said paint cartridges and a cartridge gripper means having a couple of gripper members for gripping paint cartridges separately thereon and adapted to hand over paint cartridges to and from said coating apparatus along three perpendicular axes to replace an empty paint cartridge on said coating apparatus by a replenished paint cartridge, characterized in that said method comprises:

a coating step of coating an object by spraying paint onto the object using said coating apparatus loaded with a replenished paint cartridge and moved by said working mechanism;

a replenished paint cartridge pick up step of picking up said replenished paint cartridge of a color to be used in a next coating operation from a paint replenisher means by the use of one of said gripper members of said cartridge gripper means;

an empty paint cartridge unloading step of unloading said empty paint cartridge from said coating apparatus by the use of the other one of the gripper members of said cartridge gripper means, while said cartridge gripper means has said replenished paint cartridge still gripped in said one gripper member;

a replenished paint cartridge loading step of loading said replenished paint cartridge on said coating apparatus by said one gripper member of said cartridge gripper means, with said cartridge gripper means having said empty paint cartridge still gripped on said other gripper member; and an unloading empty paint cartridge returning step of returning said unloaded empty paint cartridge to said paint replenishing means.

2. An automatic coating method using a working mechanism, a coating apparatus mounted on the working mechanism and adapted to be replaceably loaded with paint cartridges of various colors, and a cartridge changer including a paint replenisher, cartridge gripper members, and a cartridge transfer system configured to move the gripper member along three perpendicular axes, said method comprises the steps of:

coating an object by spraying paint onto the object using the coating apparatus loaded with a first paint cartridge and moved by the working mechanism;

picking up a second paint cartridge from a paint replenisher using one of the gripper members;

unloading the first paint cartridge from the coating apparatus using the other one of the gripper members, wherein the second paint cartridge is still gripped in the one gripper member;

loading the second paint cartridge on the coating apparatus using the one gripper member, wherein the first paint cartridge is still gripped on the other gripper member; and returning the first paint cartridge to the paint replenisher.

* * * * *